US006867761B2

(12) United States Patent
Matsueda

(10) Patent No.: US 6,867,761 B2
(45) Date of Patent: Mar. 15, 2005

(54) ELECTRO-OPTICAL DEVICE AND METHOD OF DRIVING THE SAME, ORGANIC ELECTROLUMINESCENT DISPLAY DEVICE, AND ELECTRONIC APPARATUS

(75) Inventor: Yojiro Matsueda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 467 days.

(21) Appl. No.: 09/964,356

(22) Filed: Sep. 28, 2001

(65) Prior Publication Data

US 2002/0041278 A1 Apr. 11, 2002

(30) Foreign Application Priority Data

Sep. 29, 2000 (JP) ..... 2000-300934
Sep. 27, 2001 (JP) ..... 2001-296479

(51) Int. Cl.[7] ..... G09G 3/36
(52) U.S. Cl. ..... 345/100; 345/98; 345/213
(58) Field of Search ..... 345/98, 99, 100, 345/88, 89, 76, 77, 690, 698, 212, 213

(56) References Cited

U.S. PATENT DOCUMENTS 4,688,896 A * 8/1987 Castleberry ..... 349/55
5,168,270 A 12/1992 Masumori et al.
5,394,166 A * 2/1995 Shimada ..... 345/98
5,856,816 A * 1/1999 Youn ..... 345/98
5,867,140 A * 2/1999 Rader ..... 345/98
5,881,299 A * 3/1999 Nomura et al. ..... 713/324
5,905,483 A * 5/1999 Yuki ..... 345/98
5,929,839 A * 7/1999 Matsumoto ..... 345/589
6,023,260 A 2/2000 Higashi
6,091,389 A * 7/2000 Maeda et al. ..... 345/98
6,281,700 B1 8/2001 Matsueda
6,697,037 B1 * 2/2004 Alt et al. ..... 345/93

FOREIGN PATENT DOCUMENTS

CN 1399772 A 2/2003
EP 0 852 371 A1 7/1998
WO WO 01/39167 A1 5/2001

OTHER PUBLICATIONS

Matsueda, Y. et al., 30.1: A 6–bit–Color VGA Low–Temperature Poly–Si TFT–LCD with Integrated Digital Data Drivers; SID 98 Digest, pp. 879–822; 1998.

* cited by examiner

*Primary Examiner*—Kent Chang
(74) *Attorney, Agent, or Firm*—Oliff & Berridge, PLC

(57) ABSTRACT

The present invention reduces the power consumption of an organic electroluminescent display device. An organic electroluminescent display device can include organic electroluminescent elements corresponding to R, G, and B colors, holding capacitance, etc., which are disposed at intersections of data lines and scan lines which are arranged in a matrix manner. The display device can further include, a data line driving circuit, and a scan line driving circuit. The scan line driving circuit can include a decoder. An auxiliary data line driving circuit can also be provided in addition to the data line driving circuit. The auxiliary data line driving circuit includes a decoder, and a plurality of switching elements. First ends of the switching elements are selectively connected to only selected data lines of the data lines which correspond to the organic electroluminescent elements capable of emitting green (G). Second ends of the switching elements are connected to a power supply line on which a character display voltage VCHR for causing the organic electroluminescent elements to emit light can be fed.

73 Claims, 13 Drawing Sheets

[FIG. 1]
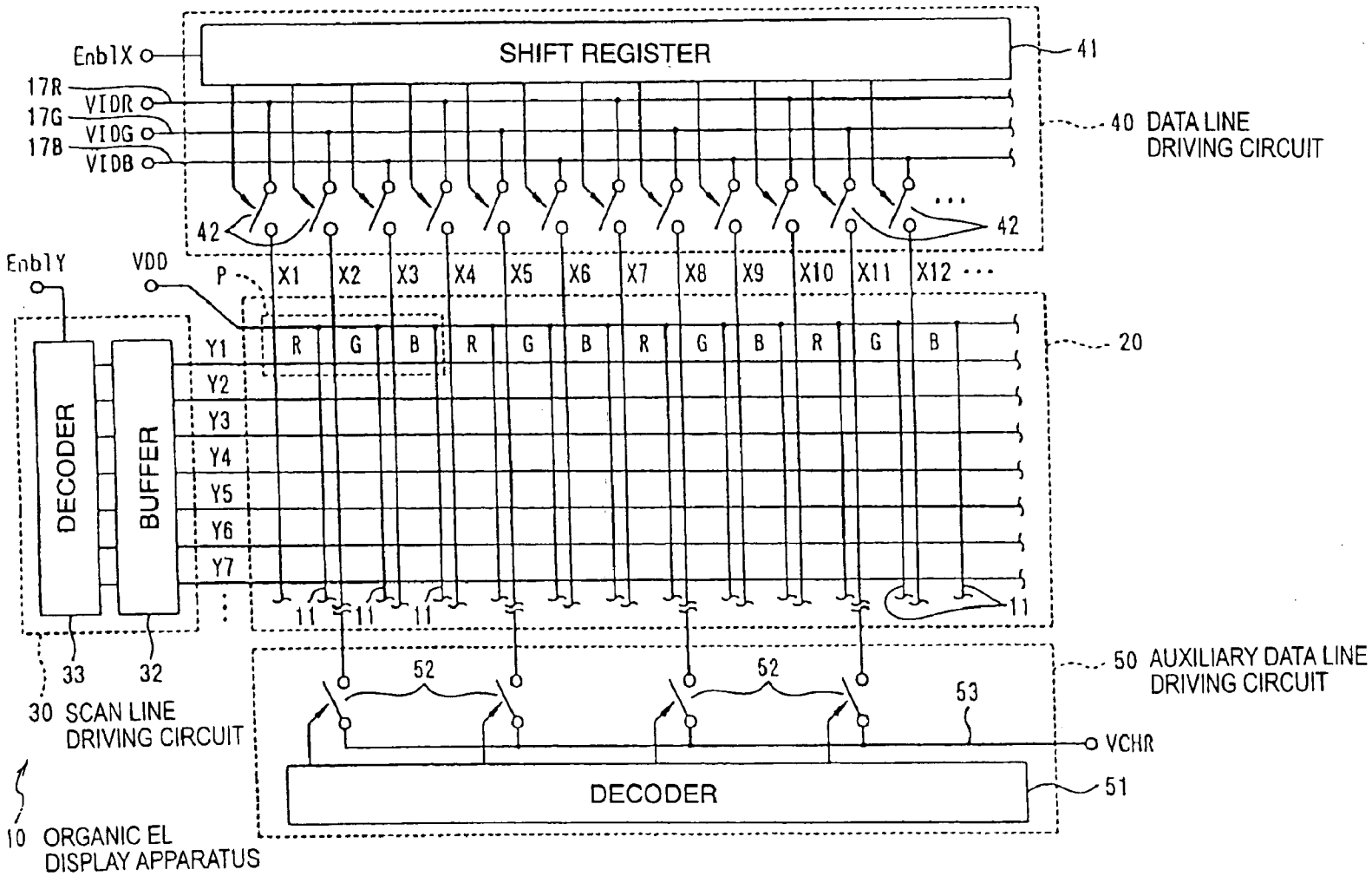

[FIG. 2]
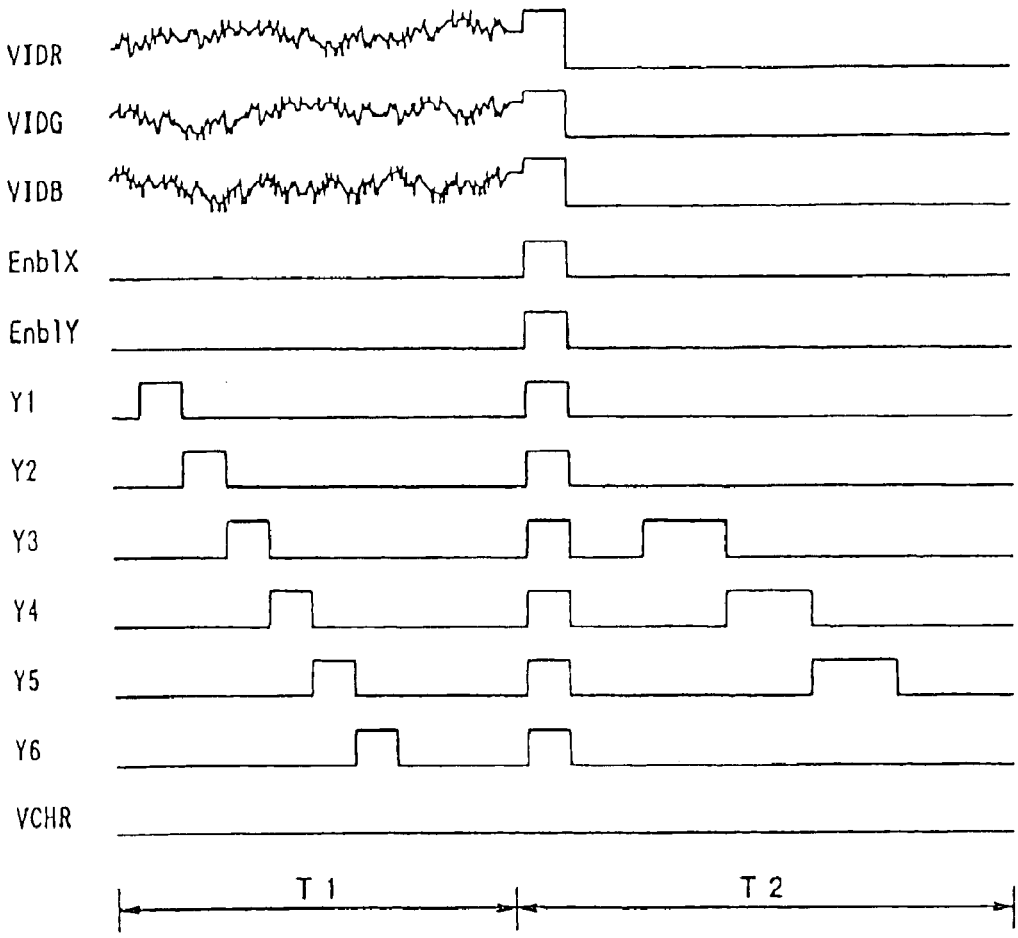

[FIG. 3]
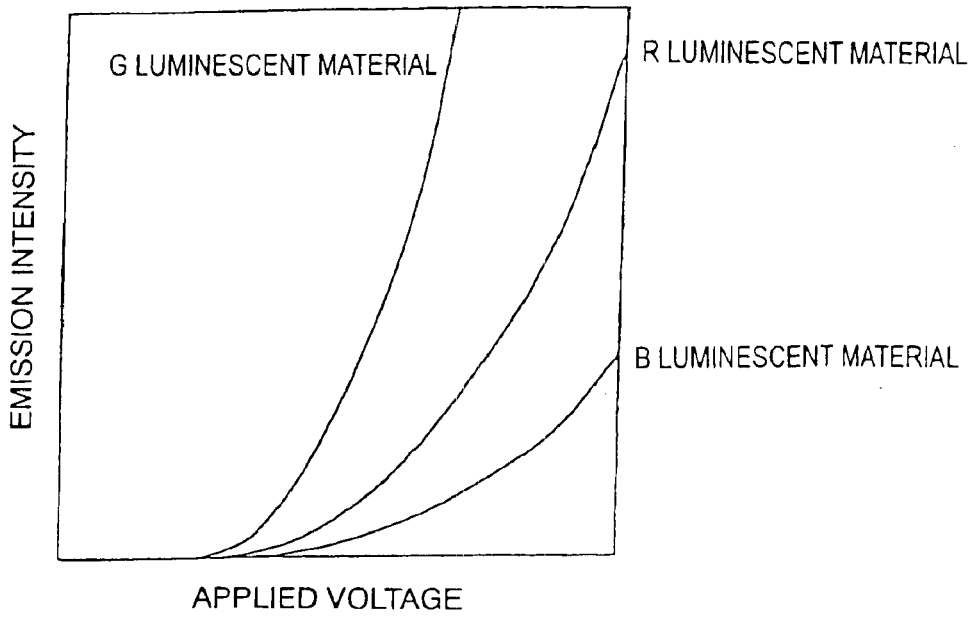
[FIG. 4]
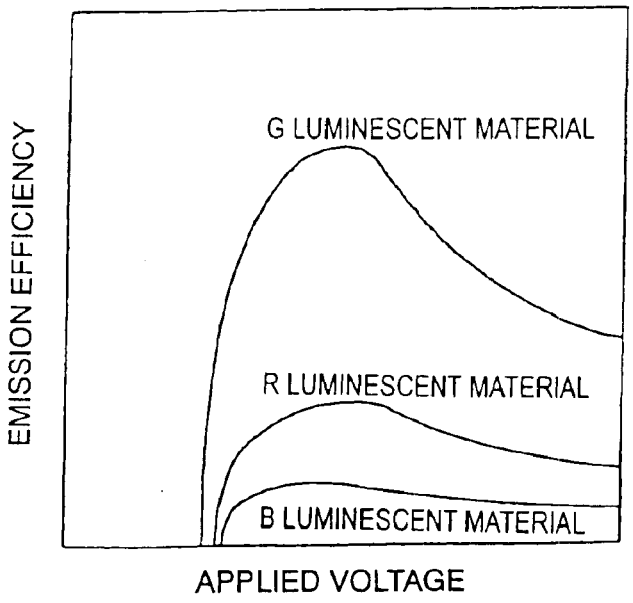

[FIG. 5]
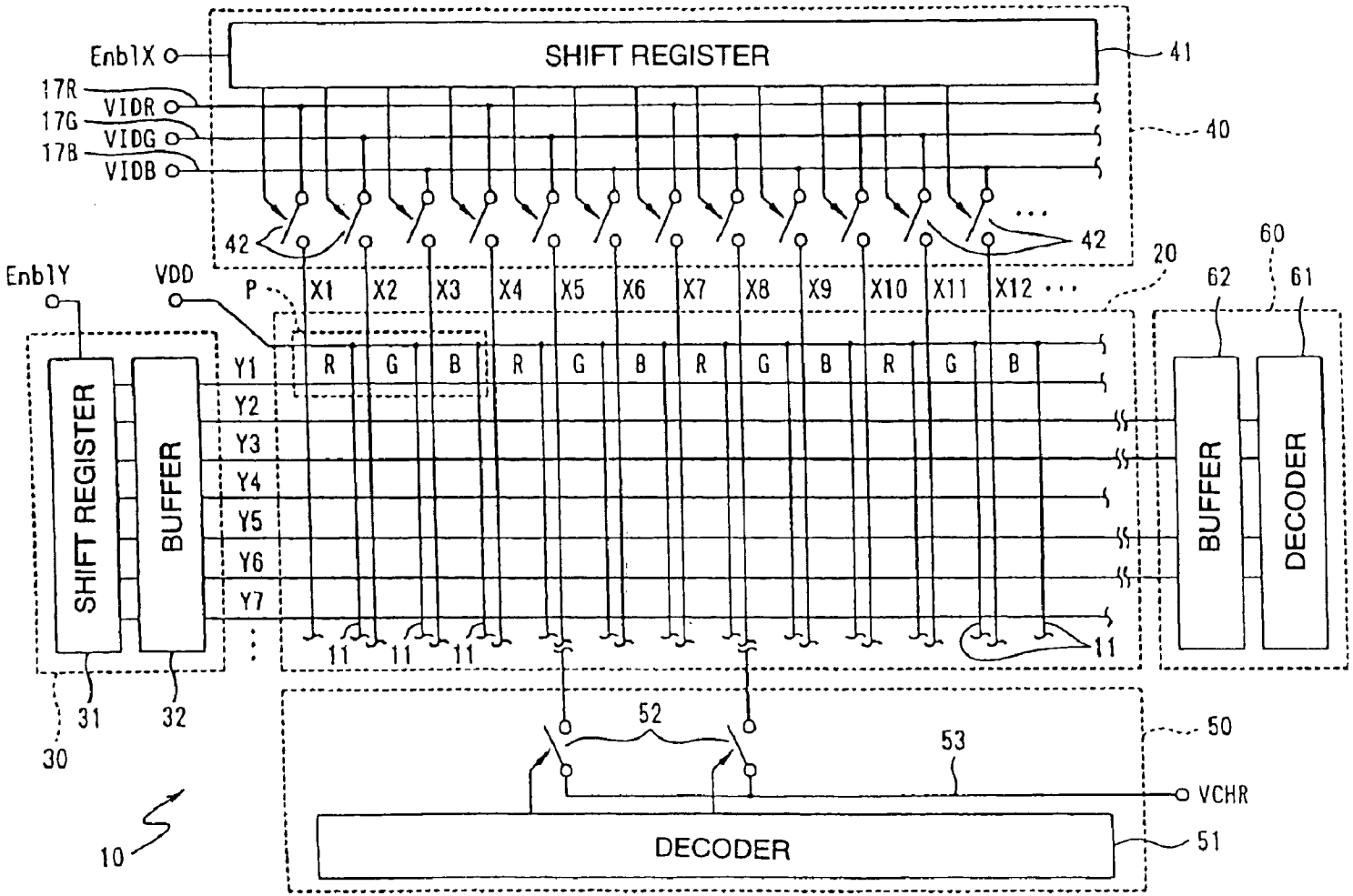

[FIG. 6]
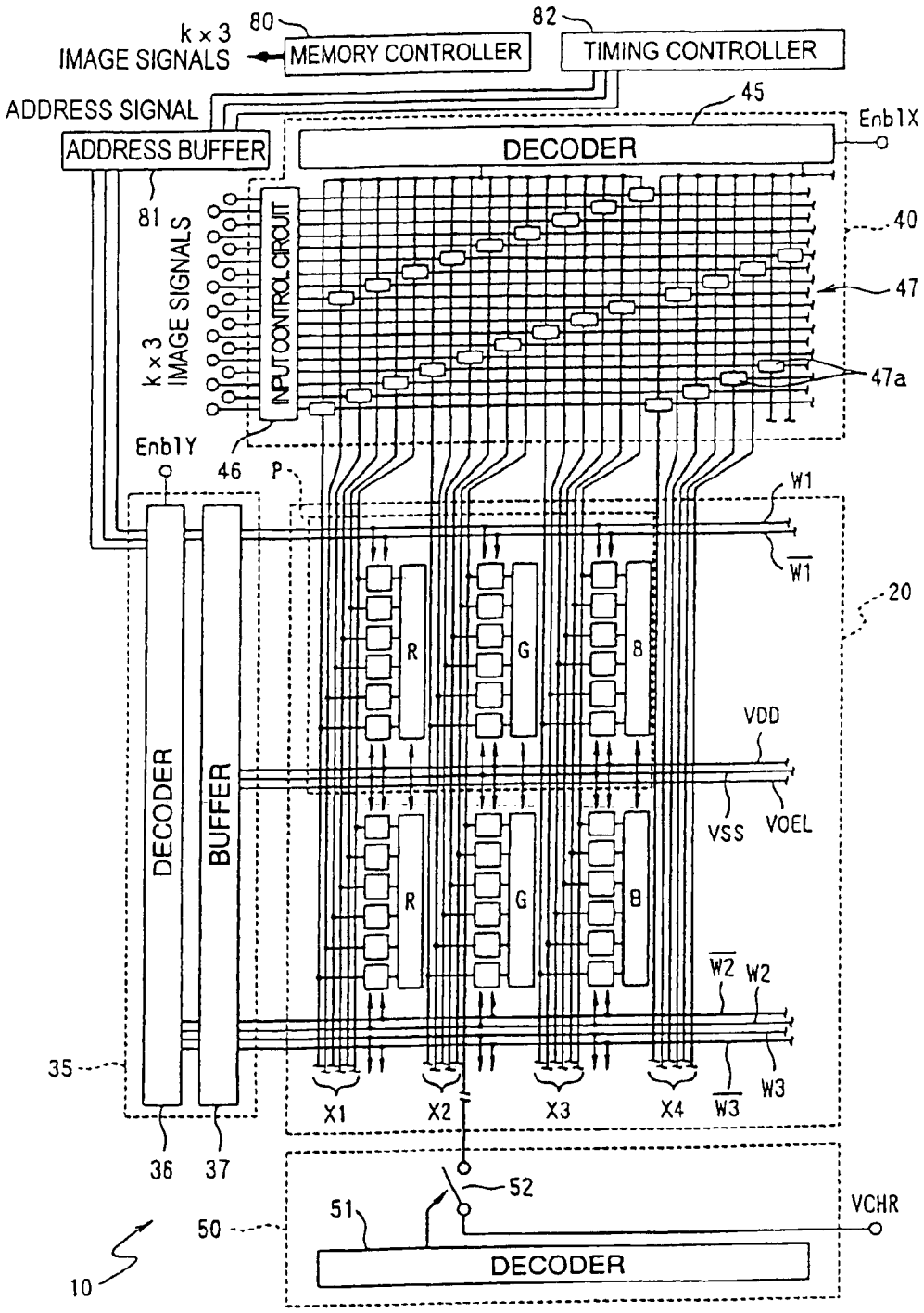

[FIG. 7]
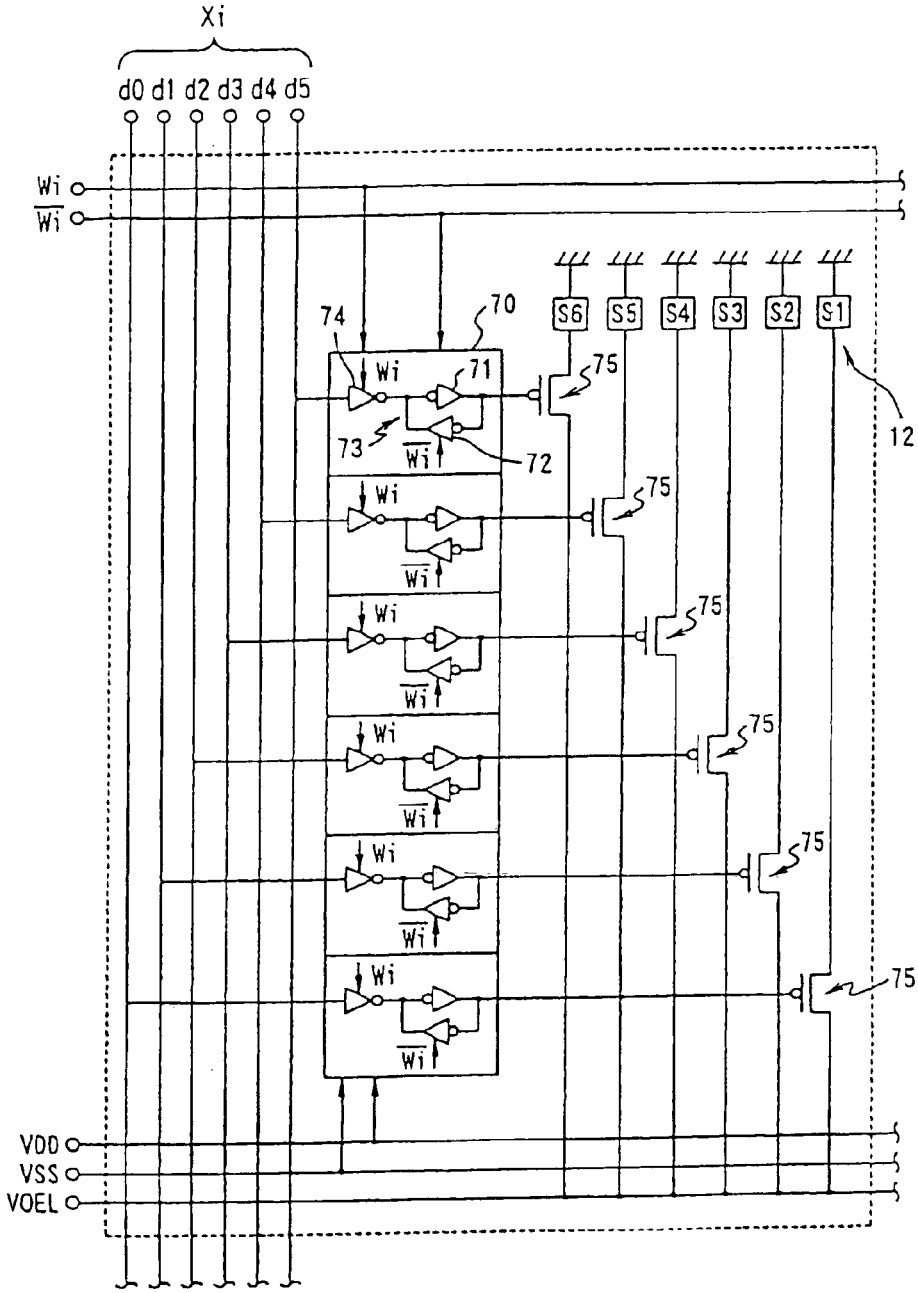

[FIG. 8]
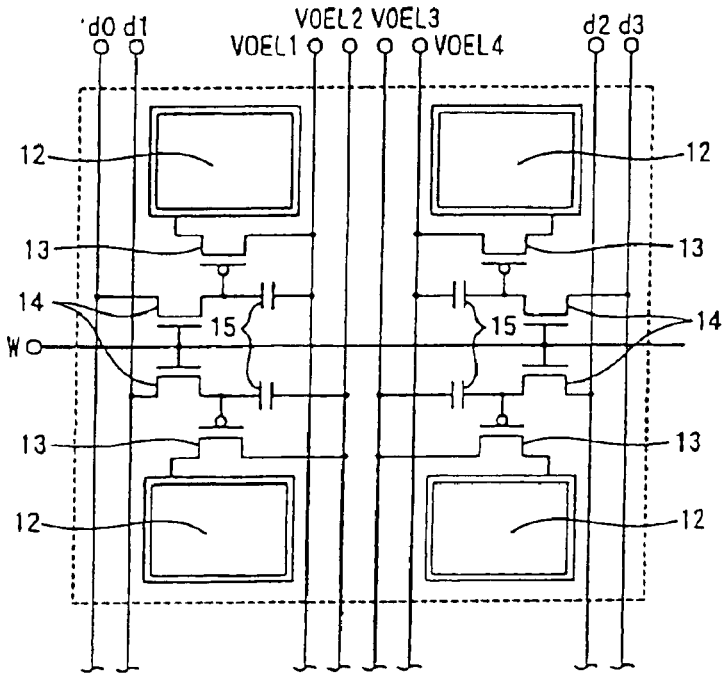
[FIG. 9]
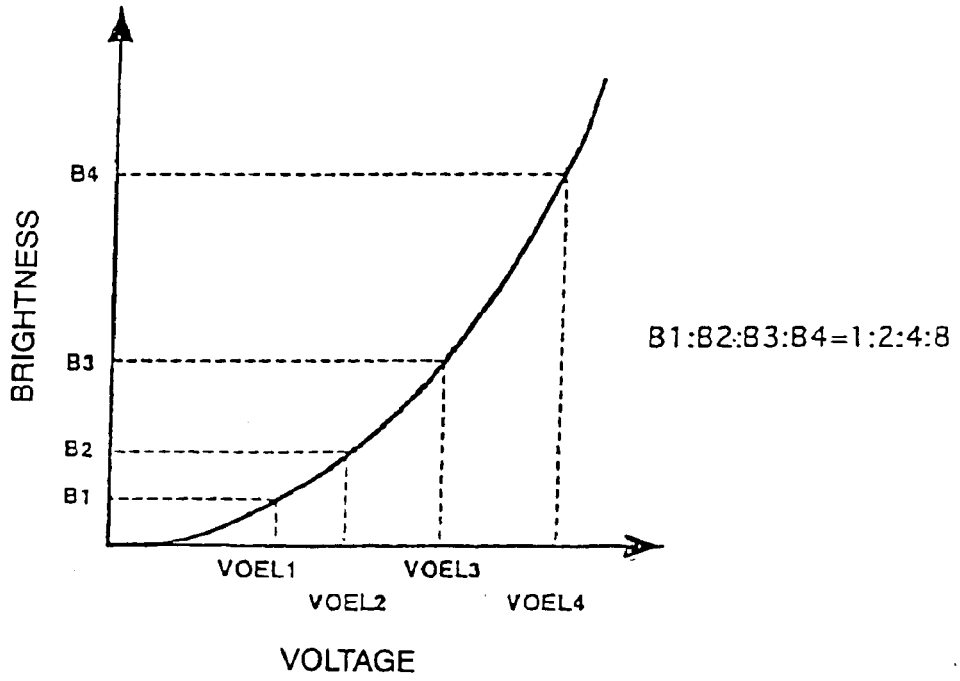

[FIG. 10]
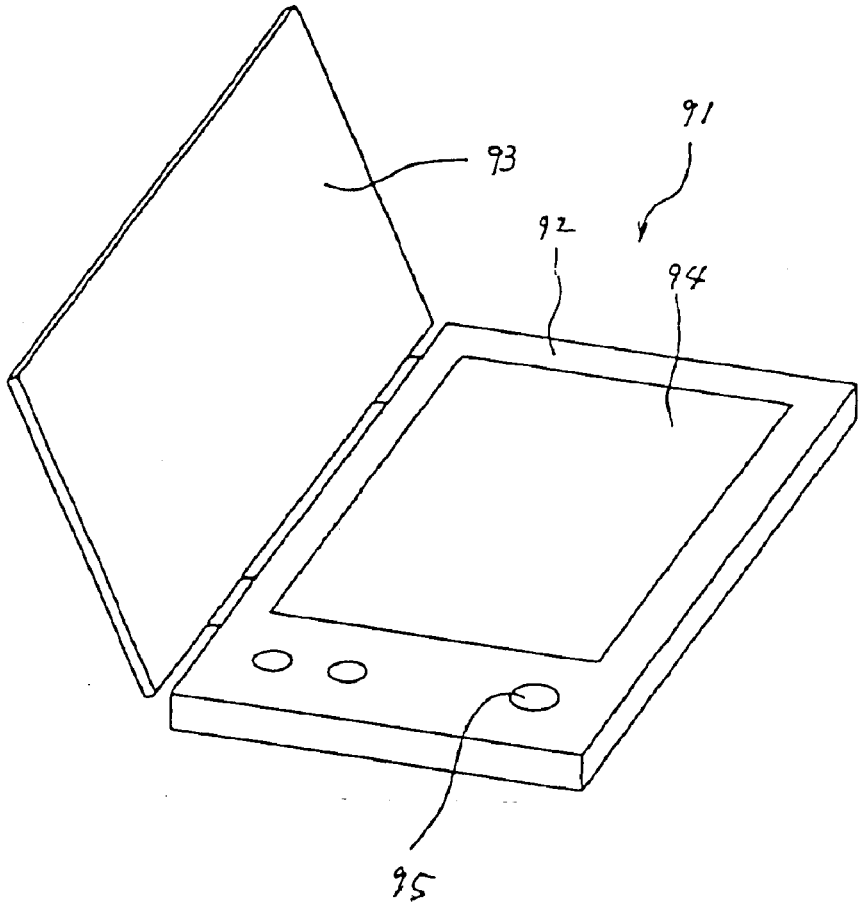

[FIG. 11]
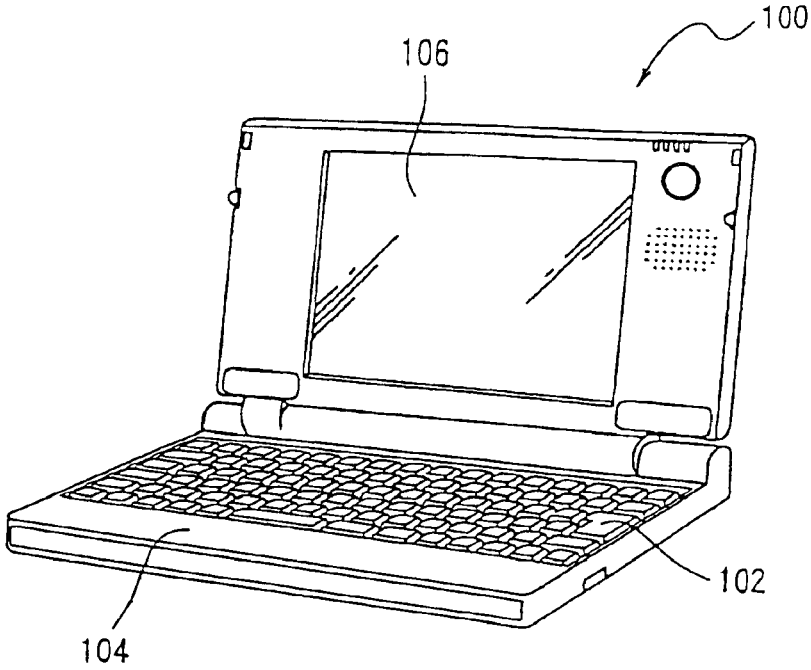
[FIG. 12]
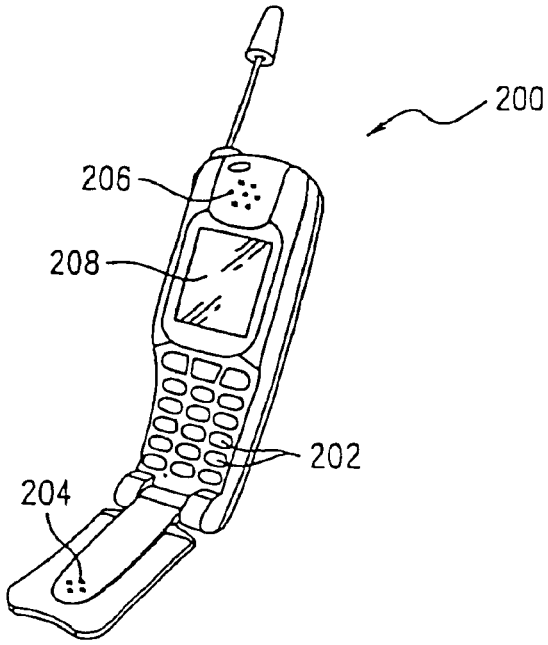

[FIG. 13]
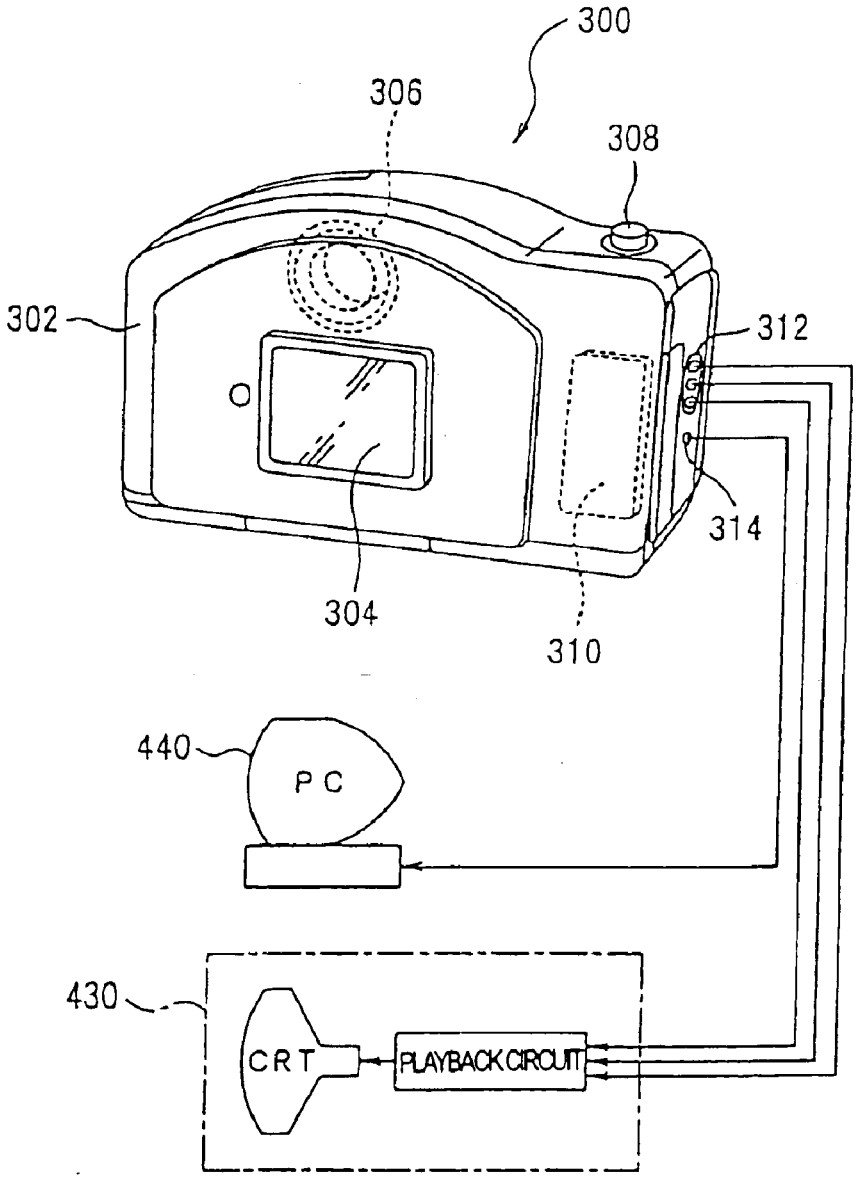

[FIG. 14]
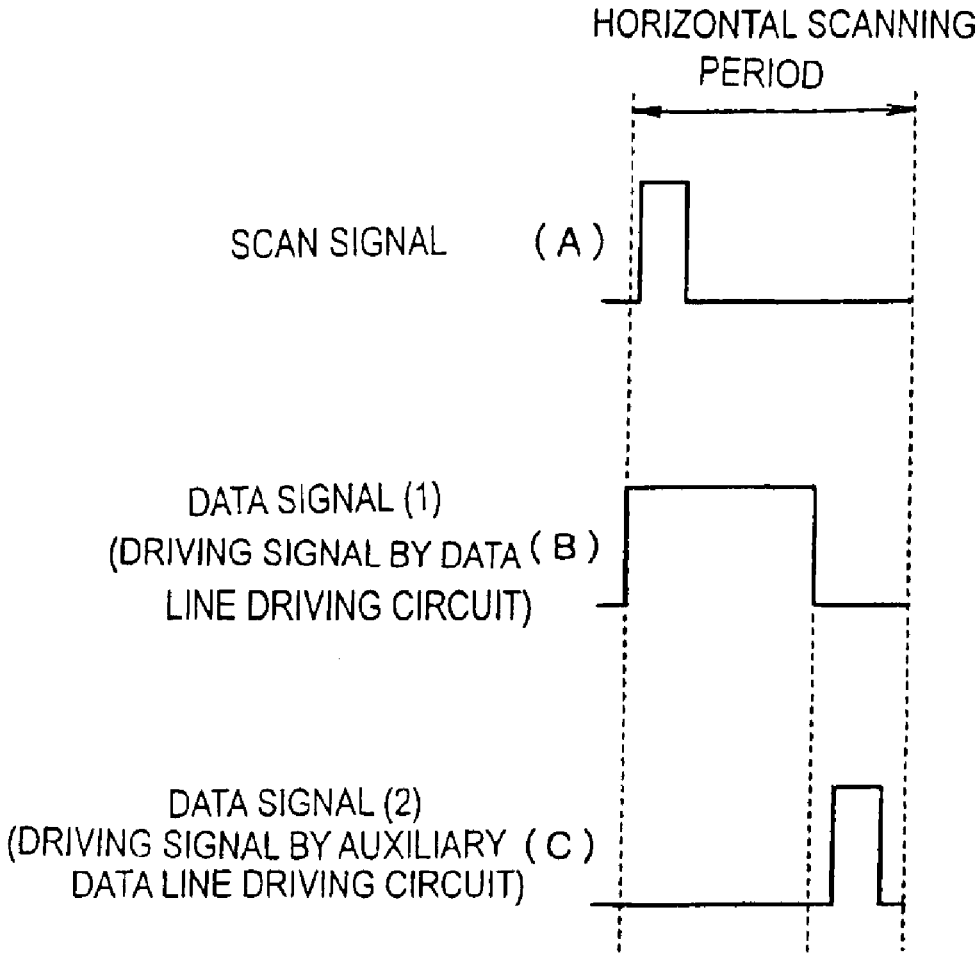

[FIG. 15]
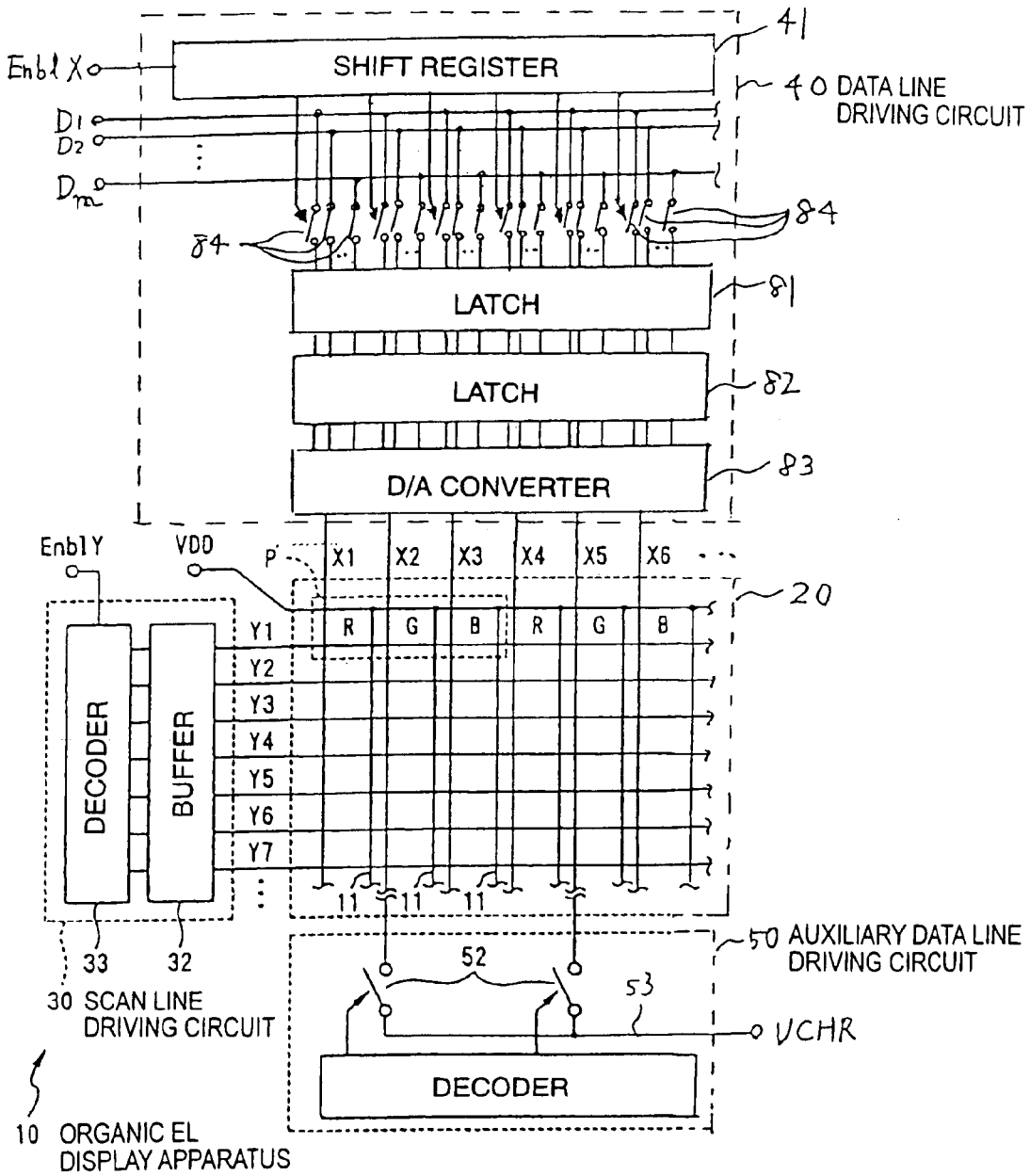

[FIG. 16]
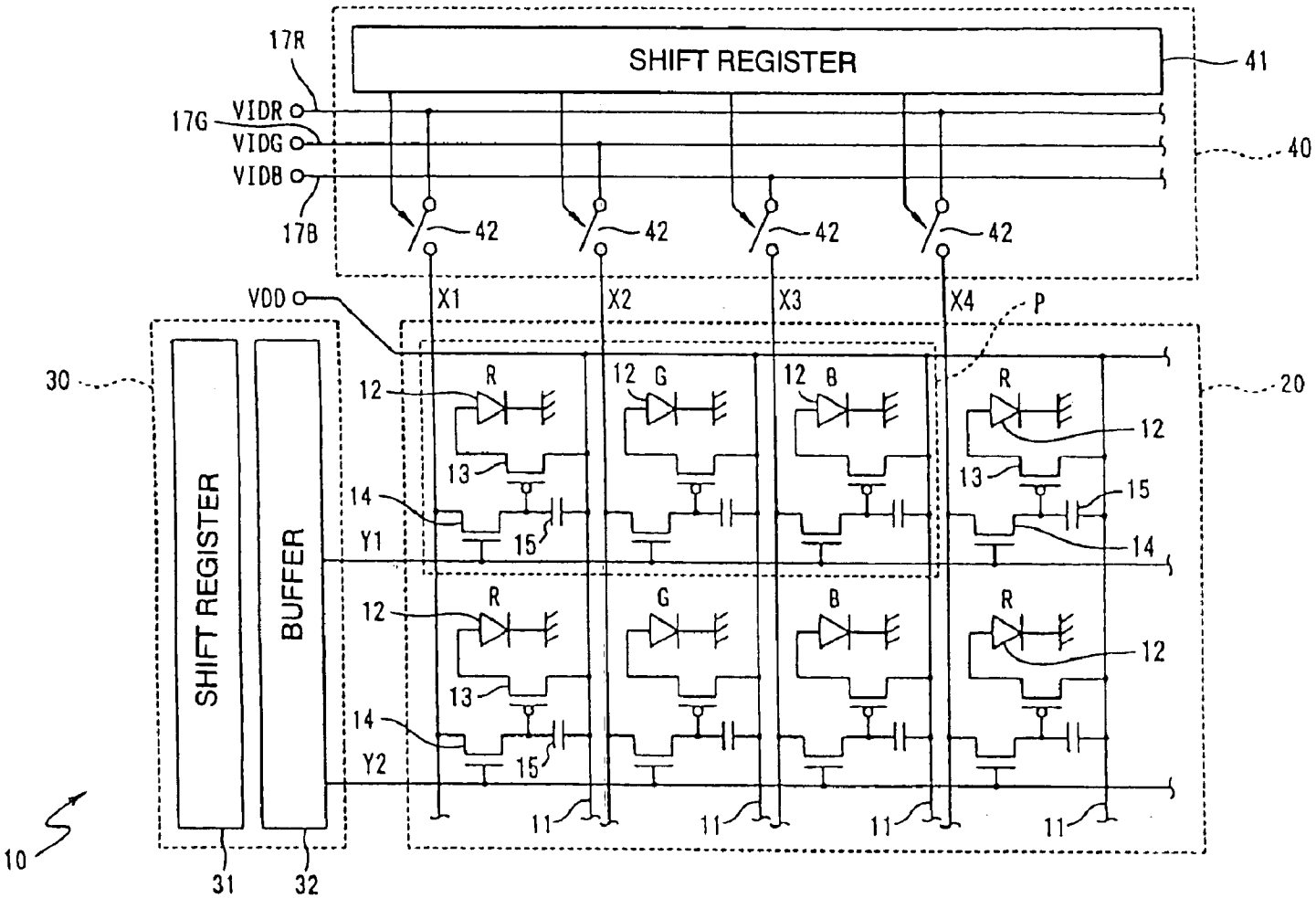

ELECTRO-OPTICAL DEVICE AND METHOD OF DRIVING THE SAME, ORGANIC ELECTROLUMINESCENT DISPLAY DEVICE, AND ELECTRONIC APPARATUS

BACKGROUND OF THE INVENTION

1. Field of Invention

The present invention relates to an electro-optical device and a method of driving the same, an organic electroluminescent display device using (electroluminescence) elements, and an electronic apparatus having an electro-optical device or an organic electroluminescent display device. The invention is particularly intended to achieve a reduction in power consumption with a simple circuit structure.

2. Description of Related Art

Currently, electro-optical devices that display data which are incorporated in electronic apparatuses can include a liquid crystal display device, an electrophoresis device, and an organic electroluminescent display device. The organic electroluminescent display device can be constructed using organic electroluminescent elements that are electro-optical elements. FIG. 16 shows the structure of a conventional organic electroluminescent display device 10. FIG. 16 illustrates only portions corresponding to four data lines X1 to X4 and two scan lines Y1 and Y2 in the organic electroluminescent display device 10.

The organic electroluminescent display device 10 includes a plurality of data lines X1 to X4 which extend in the column direction, a plurality of scan lines Y1 and Y2 which extend in the row direction, and common feeder lines 11 extending in parallel to the data lines X1 to X4 and having first ends connected to a power supply VDD. Organic electroluminescent elements 12 which function as color-emitting units are disposed correspondingly to intersections of the data lines X1 to X4 and the scan lines Y1 and Y2. In this example, the organic electroluminescent elements 12 capable of emitting red (R), the organic electroluminescent element 12 capable of emitting green (G), and the organic electroluminescent element 12 capable of emitting blue (B) are in turn associated with the data lines X1 to X4 in such a manner that the first data line X1, the second data line X2, the third data line X3, and the fourth data line X4 correspond to R, G, B, and R, respectively. Three dots including an organic electroluminescent element 12 capable of emitting red, an organic electroluminescent element 12 capable of emitting green, and an organic electroluminescent element 12 capable of emitting blue which are aligned in the row direction constitute one pixel P, allowing the organic electroluminescent display device 10 to achieve a color display.

The cathode side of each of the organic electroluminescent elements 12 is grounded, while the hole injection side thereof is connected to the common feeder line 11 via a p-channel thin film MOS transistor (hereinafter, referred to as PMOS transistor) 13. The gates of the PMOS transistors 13 are connected to the associated data lines X1 to X4 via n-channel thin film MOS transistors (hereinafter referred to as NMOS transistors) 14, and holding capacitances 15 are interposed between the gates of the PMOS transistors 13 and the common feeder lines 11. The gates of the NMOS transistors 14 are connected to the associated scan lines Y1 and Y2. The organic electroluminescent elements 12, the PMOS transistors 13, the NMOS transistors 14, and the holding capacitances 15 constitute a so-called active matrix display screen 20.

First ends of the scan lines Y1 and Y2 are connected to a scan line driving circuit 30. The scan line driving circuit 30 includes a shift register 31 and a buffer 32, in which outputs of the shift register 31 are fed to the scan lines Y1 and Y2 via the buffer 32. In synchronization with the shift operation of the shift register 31, therefore, the plurality of scan lines Y1 and Y2 are selected in turn to each repeat charging and discharging.

On the other hand, first ends of the data lines X1 to X4 are connected to a data line driving circuit 40. The data line driving circuit 40 includes a shift register 41, and a plurality of switching elements 42 corresponding to the data lines X1 to X4, in which outputs of the shift register 41 are fed to the switching elements 42. In synchronization with the shift operation of the shift register 41, therefore, the switching elements 42 are selected in turn to be each repeatedly turned on (conduct) and off (interrupt).

The side of each of the switching elements 42 which is opposite to the data lines X1 to X4 is connected to one of video signal lines 17R, 17G, and 17B. The video signal lines 17R to 17B are signal lines which supply analog video signal voltages VIDR, VIDG, VIDB corresponding to red (R), green (G), and blue (B), and are adjacent to the display screen 20, extending in parallel to the scan lines Y1 and Y2. Therefore, each of the data lines X1 to X4 is connected to one of the video signal lines 17R, 17G, and 17B via the switching element 42 so that the video signal voltage VIDR, VIDG, and VIDB of the same color as the color emitted by the organic electroluminescent element 12 connected thereto can be supplied.

The period of the shift operation of the shift register 31 is a period in which the shift operation of the shift register 41 is performed to complete a selection of a scan line Yi and to initiate a selection of the next scan line Y(i+1) at a timing of the completion of selections of all of the data lines X1, X2, . . . , and Xn.

With the above-described structure, the shift operations of the shift register 31 and the shift register 41 allow all of the scan lines Y1, Y2, . . . , and Ym to be sequentially selected, and allow all of the data lines X1, X2, . . . , and Xn to be sequentially selected while the scan lines Y1 to Ym are selected, so that an image can be output using the entire display screen 20. One of the video signal voltages VIDR, VIDG, and VIDB is supplied to each of the data lines X1 to Xn from the corresponding video signal lines 17R to 17B when it is selected, and that video signal voltage VIDR, VIDG, or VIDB is charged in the holding capacitance 15 via the NMOS transistor 14 selected by the scan line Yi. The channel of the PMOS transistor 13 is controlled according to the charging state of the holding capacitance 15, so that a current which flows to each of the organic electroluminescent elements 12 from the common feeder lines 11 becomes a value corresponding to the video signal voltage VIDR, VIDG, or VIDB, thereby making it possible to cause the organic electroluminescent elements 12 to emit light at the desired brightness.

SUMMARY OF THE INVENTION

The conventional organic electroluminescent display device 10 has no particular problem with respect to an operation for outputting an image using the display screen 20, and is rather significantly efficient for outputting an image using the entire screen. However, since the conventional organic electroluminescent display device 10 is designed so that the scan line driving circuit 30 is used to sequentially drive all of the scan lines Y1, Y2, and Ym while the data line driving circuit 40 is used to sequentially drive all of the data lines X1, X2, . . . , and Xn, data must be updated on the entire screen, for example, even if a character such as a letter or a symbol is displayed. In order to update the data on the entire screen, all of the data lines X1 to Xn and all of the scan lines Y1 to Ym must be sequentially driven, and, in particular, the data lines X1 to Xn must be driven in an extremely short period. Therefore, a need exists to repeatedly charge and discharge the data lines X1 to Xn at a high rate. A further need exists to drive all of the scan lines Y1 to Ym including the ones which are located in a region where the character is not displayed.

Accordingly, with the conventional structure, when a character such as a letter or a symbol is displayed, an operation which requires a large power consumption must be performed in a similar way to the case where an image is displayed, and the scan lines Y1 to Ym must also be driven in a region where the character is not displayed, thereby requiring wasteful power consumption.

Furthermore, when not only display control but also disconnection tests or precharging is performed, power is wastefully consumed.

The present invention has been made in view of the unaddressed problems associated with the conventional art, and has an object to provide an electro-optical device capable of suppressing wasteful power consumption, a method of driving the same, an organic electroluminescent display device, and an electronic apparatus.

In order to achieve the foregoing object, an electro-optical device in a first aspect of the present invention can be an electro-optical device including a plurality of data lines and scan lines which are arranged in a matrix manner. The invention can further include electro-optical elements which are disposed correspondingly to intersections of the data lines and the scan lines, characterized by including a data line driving circuit capable of driving the data lines, and an auxiliary data line driving circuit capable of driving the data lines separately from the data line driving circuit.

An electro-optical device in a second aspect of the present invention can be characterized in that, in an electro-optical device which is the electro-optical device in the first aspect of the present invention, all of the data lines are connected to the data line driving circuit, and only a portion of the data lines is selectively connected to the auxiliary data line driving circuit.

An electro-optical device in a third aspect of the present invention can be characterized in that, in the electro-optical device in the first or second aspect of the present invention, at least one of the data line driving circuit and the auxiliary data line driving circuit includes a decoder.

An electro-optical device in a fourth aspect of the present invention can be characterized in that, in the electro-optical device in the first to third aspects of the present invention, at least one of the data line driving circuit and the auxiliary data line driving circuit includes a shift register.

An electro-optical device in a fifth aspect of the present invention can be characterized in that, in the electro-optical device in the first to fourth aspects of the present invention, at least one of the data line driving circuit and the auxiliary data line driving circuit includes a latch circuit.

An electro-optical device in a sixth aspect of the present invention can be characterized in that, in the electro-optical device in the first to fifth aspects of the present invention, at least one of the data line driving circuit and the auxiliary data line driving circuit includes a D/A converter circuit.

An electro-optical device in a seventh aspect of the present invention can be characterized in that, in the electro-optical device in the first to sixth aspects of the present invention, of the data lines, only a data line that is located in a specific region of a screen is selectively connected to the auxiliary data line driving circuit.

An electro-optical device in an eighth aspect of the present invention can be characterized in that, in the electro-optical device in the first to seventh aspects of the present invention, three dots consisting of an electro-optical element capable of emitting red, an electro-optical element capable of emitting green, and an electro-optical element capable of emitting blue constitute one pixel to enable a color display, and only a data line corresponding to a particular color of the three colors is selectively connected to the auxiliary data line driving circuit.

An electro-optical device in a ninth aspect of the present invention can be characterized in that, in the electro-optical device in the eighth aspect of the present invention, only a data line which corresponds to the particular color and which is located in a specific region of a screen is selectively connected to the auxiliary data line driving circuit.

An electro-optical device in a tenth aspect of the present invention can be characterized in that, in the electro-optical device in the first to ninth aspects of the present invention, a full-dot display mode and a character display mode can be switched so that the data line driving circuit is enabled when the full-dot display mode is selected and the auxiliary data line driving circuit is enabled when the character display mode is selected.

An electro-optical device in an eleventh aspect of the present invention can be characterized by, in the electro-optical device in the first to tenth aspects of the present invention, further including a scan line driving circuit capable of driving the scan lines, and an auxiliary scan line driving circuit capable of driving the scan lines separately from the scan line driving circuit, wherein all of the scan lines are connected to the scan line driving circuit and only a portion of the scan lines is selectively connected to the auxiliary scan line driving circuit.

An electro-optical device in a twelfth aspect of the present invention can be characterized in that, in the electro-optical device in the eleventh aspect of the present invention, at least one of the scan line driving circuit and the auxiliary scan line driving circuit includes a decoder.

An electro-optical device in a thirteenth aspect of the present invention can be characterized in that, in the electro-optical device in the eleventh or twelfth aspect of the present invention, at least one of the scan line driving circuit and the auxiliary scan line driving circuit includes a shift register.

An electro-optical device in a fourteenth aspect of the present invention can be characterized in that, in the electro-optical device in the eleventh to thirteenth aspects of the present invention, of the scan lines, only a scan line that is located in a specific region of a screen is selectively connected to the auxiliary scan line driving circuit.

An electro-optical device in a fifteenth aspect of the present invention can be characterized in that, in the electro-optical device in the eleventh to fourteenth aspects of the present invention, a full-dot display mode and a character display mode can be switched so that the data line driving circuit and the scan line driving circuit are enabled when the full-dot display mode is selected and the auxiliary data line driving circuit and the auxiliary scan line driving circuit are enabled when the character display mode is selected.

An electro-optical device in a sixteenth aspect of the present invention can be characterized in that, in the electro-optical device in the tenth or fifteenth aspect of the present invention, the number of grayscale levels is smaller when the character display mode is selected than when the full-dot display mode is selected.

An electro-optical device in a seventeenth aspect of the present invention cam be characterized in that, in the electro-optical device in the tenth, fifteenth, or sixteenth aspect of the present invention, a frame frequency is lower when the character display mode is selected than when the full-dot display mode is selected.

An electro-optical device in an eighteenth aspect of the present invention can be characterized in that, in the electro-optical device in the tenth, fifteenth, sixteenth, or seventeenth aspect of the present invention, all pixels can be reset altogether when the full-dot display mode changes to the character display mode.

An electro-optical device in a nineteenth aspect of the present invention can be characterized in that, in the electro-optical device in the first to eighteenth aspects of the present invention, the data lines are driven by switching between the data line driving circuit and the auxiliary data line driving circuit in a period during which scan lines of one screen are being driven.

In order to further achieve the foregoing object, a method of driving an electro-optical device in the first aspect of the present invention can be a method of driving an electro-optical device including a plurality of data lines and scan lines which are arranged in a matrix manner, and electro-optical elements which are disposed correspondingly to intersections of the data lines and the scan lines. The method can include switching between a data line driving circuit and an auxiliary data line driving circuit to drive the data lines, the data line driving circuit being capable of driving the data lines, the auxiliary data line driving circuit being capable of driving the data lines separately from the data line driving circuit.

A method of driving an electro-optical device in the second aspect of the present invention can be characterized in that, in the method of driving an electro-optical device in the first aspect of the present invention, all of the data lines are connected to the data line driving circuit, and only a portion of the data lines is selectively connected to the auxiliary data line driving circuit.

A method of driving an electro-optical device in the third aspect of the present invention can be characterized in that, in the method of driving an electro-optical device in the first or second aspect of the present invention, at least one of the data line driving circuit and the auxiliary data line driving circuit includes a decoder.

A method of driving an electro-optical device in the fourth aspect of the present invention can be characterized in that, in the method of driving an electro-optical device in the first to third aspects of the present invention, at least one of the data line driving circuit and the auxiliary data line driving circuit includes a shift register.

A method of driving an electro-optical device in the fifth aspect of the present invention can be characterized in that, in the method of driving an electro-optical device in the first to fourth aspects of the present invention, at least one of the data line driving circuit and the auxiliary data line driving circuit includes a latch circuit.

A method of driving an electro-optical device in the sixth aspect of the present invention can be characterized in that, in the method of driving an electro-optical device in the first to fifth aspects of the present invention, at least one of the data line driving circuit and the auxiliary data line driving circuit includes a D/A converter circuit.

A method of driving an electro-optical device in the seventh aspect of the present invention can be characterized in that, in the method of driving an electro-optical device in the first to sixth aspects of the present invention, of the data lines, only a data line that is located in a specific region of a screen is selectively connected to the auxiliary data line driving circuit.

A method of driving an electro-optical device in the eighth aspect of the present invention can be characterized in that, in the method of driving an electro-optical device in the first to seventh aspects of the present invention, three dots consisting of an electro-optical element capable of emitting red, an electro-optical element capable of emitting green, and an electro-optical element capable of emitting blue constitute one pixel to enable a color display, and only a data line corresponding to a particular color of the three colors is selectively connected to the auxiliary data line driving circuit.

A method of driving an electro-optical device in the ninth aspect of the present invention can be characterized in that, in the method of driving an electro-optical device in the eighth aspect of the present invention, only a data line which corresponds to the particular color and which is located in a specific region of a screen is selectively connected to the auxiliary data line driving circuit.

A method of driving an electro-optical device in the tenth aspect of the present invention can be characterized in that, in the method of driving an electro-optical device in the first to ninth aspects of the present invention, a full-dot display mode and a character display mode can be switched so that the data line driving circuit is enabled when the full-dot display mode is selected and the auxiliary data line driving circuit is enabled when the character display mode is selected.

A method of driving an electro-optical device in the eleventh aspect of the present invention can be characterized by, in the method of driving an electro-optical device in the first to tenth aspects of the present invention, switching between a scan line driving circuit and an auxiliary scan line driving circuit to drive the scan lines, the scan line driving circuit to which all of the scan lines are connected being capable of driving the scan lines, the auxiliary scan line driving circuit to which only a portion of the scan lines is selectively connected being capable of driving the portion of the scan lines separately from the scan line driving circuit.

A method of driving an electro-optical device in the twelfth aspect of the present invention can be characterized in that, in the method of driving an electro-optical device in the eleventh aspect of the present invention, at least one of the scan line driving circuit and the auxiliary scan line driving circuit includes a decoder.

A method of driving an electro-optical device in a thirteenth aspect of the present invention can be characterized in that, in the method of driving an electro-optical device in the eleventh or twelfth aspect of the present invention, at least one of the scan line driving circuit and the auxiliary scan line driving circuit includes a shift register.

A method of driving an electro-optical device in the fourteenth aspect of the present invention can be characterized in that, in the method of driving an electro-optical device in the eleventh to thirteenth aspects of the present invention, of the scan lines, only a scan line that is located in a specific region of a screen is selectively connected to the auxiliary scan line driving circuit.

A method of driving an electro-optical device in the fifteenth aspect of the present invention can be characterized in that, in the method of driving an electro-optical device in the eleventh to fourteenth aspects of the present invention, a full-dot display mode and a character display mode can be switched so that the data line driving circuit and the scan line driving circuit are enabled when the full-dot display mode is selected and the auxiliary data line driving circuit and the auxiliary scan line driving circuit are enabled when the character display mode is selected.

A method of driving an electro-optical device in the sixteenth aspect of the present invention can be characterized in that, in the method of driving an electro-optical device in the tenth or fifteenth aspect of the present invention, the number of grayscale levels is smaller when the character display mode is selected than when the full-dot display mode is selected.

A method of driving an electro-optical device in the seventeenth aspect of the present invention can be characterized in that, in the method of driving an electro-optical device in the tenth, fifteenth, or sixteenth aspect of the present invention, a frame frequency is lower when the character display mode is selected than when the full-dot display mode is selected.

A method of driving an electro-optical device in the eighteenth aspect of the present invention can be characterized in that, in the method of driving an electro-optical device in the tenth, fifteenth, sixteenth, or seventeenth aspect of the present invention, all pixels can be reset altogether when the full-dot display mode changes to the character display mode.

A method of driving an electro-optical device in the nineteenth aspect of the present invention can be characterized in that, in the method of driving an electro-optical device in the first to eighteenth aspects of the present invention, the data lines are driven by switching between the data line driving circuit and the auxiliary data line driving circuit in a period during which scan lines of one screen are being driven.

In order to further achieve the foregoing object, an organic electroluminescent display device according to the first aspect of the present invention is an organic electroluminescent display device. The device can include a plurality of row lines and a plurality of data lines which are arranged in a matrix manner, organic electroluminescent elements which are disposed correspondingly to intersections of the row lines and the data lines, a data line driving circuit capable of driving the data lines, and a row driving circuit capable of driving the row lines, characterized by including an auxiliary data line driving circuit, separate from the data line driving circuit, that drives the data lines. The auxiliary data line driving circuit can include a decoder, wherein all of the data lines are connected to the data line driving circuit and only a portion of the data lines is selectively connected to the auxiliary data line driving circuit.

An organic electroluminescent display device in the second aspect of the present invention is an organic electroluminescent display device. The device can include a plurality of row lines and a plurality of data lines which are arranged in a matrix maimer, organic electroluminescent elements which are disposed correspondingly to intersections of the row lines and the data lines, a data line driving circuit capable of driving the data lines, and a row driving circuit capable of driving the row lines, characterized by including an auxiliary data line driving circuit, separate from the data line driving circuit, that drives the data lines, the auxiliary data line driving circuit including a shift register, wherein all of the data lines are connected to the data line driving circuit and only a portion of the data lines is selectively connected to the auxiliary data line driving circuit.

An organic electroluminescent display device in the third aspect of the present invention can be characterized in that, in the organic electroluminescent display device in the first or second aspect of the present invention, the data line driving circuit includes a shift register.

An organic electroluminescent display device in the fourth aspect of the present invention can be characterized in that, in the organic electroluminescent display device in the first to third aspects of the present invention, the row driving circuit includes a decoder.

An organic electroluminescent display device in the fifth aspect of the present invention can be characterized in that, in the organic electroluminescent display device in the first to fourth aspects of the present invention, of the data lines, only a data line that is located in a specific region of a screen is selectively connected to the auxiliary data line driving circuit.

An organic electroluminescent display device in the sixth aspect of the present invention can be characterized in that, in the organic electroluminescent display device in the first to fifth aspects of the present invention, three dots including an organic electroluminescent element capable of emitting red, an organic electroluminescent element capable of emitting green, and an organic electroluminescent element capable of emitting blue constitute one pixel to enable a color display, and only a data line corresponding to a particular color of the three colors is selectively connected to the auxiliary data line driving circuit.

An organic electroluminescent display device in the seventh aspect of the present invention can be characterized in that, in the organic electroluminescent display device in the sixth aspect of the present invention, the particular color is green.

An organic electroluminescent display device in the eighth aspect of the present invention can be characterized in that, in the organic electroluminescent display device in the sixth or seventh aspect of the present invention, only a data line which corresponds to the particular color and which is located in a specific region of a screen is selectively connected to the auxiliary data line driving circuit.

An organic electroluminescent display device in the ninth aspect of the present invention can be characterized in that, in the organic electroluminescent display device in the first to eighth aspects of the present invention, a full-dot display mode and a character display mode can be switched so that the data line driving circuit is enabled when the full-dot display mode is selected and the auxiliary data line driving circuit is enabled when the character display mode is selected.

An organic electroluminescent display device in the tenth aspect of the present invention can be characterized by, in the organic electroluminescent display device in the first to eighth aspects of the present invention, further including an auxiliary row line driving circuit, separate from the row driving circuit, for driving the row lines, the auxiliary row driving circuit including a decoder, wherein all of the row lines are connected to the row driving circuit and only a portion of the row lines is selectively connected to the auxiliary row driving circuit.

An organic electroluminescent display device in the eleventh aspect of the present invention can be characterized by, in the organic electroluminescent display device in the first to eighth aspects of the present invention, further including an auxiliary row driving circuit, separate from the row driving circuit, for driving the row lines, the auxiliary row driving circuit including a shift register, wherein all of the row lines are connected to the row driving circuit and only a portion of the row lines is selectively connected to the auxiliary row driving circuit.

An organic electroluminescent display device in the twelfth aspect of the present invention can be characterized in that, in the organic electroluminescent display device in the tenth or eleventh aspect of the present invention, of the row lines, only a row line that is located in a specific region of a screen is selectively connected to the auxiliary row driving circuit.

An organic electroluminescent display device in the thirteenth aspect of the present invention can be characterized in that, in the organic electroluminescent display device in the eleventh to twelfth aspects of the present invention, a full-dot display mode and a character display mode can be switched so that the data line driving circuit and the row driving circuit are enabled when the full-dot display mode is selected and the auxiliary data line driving circuit and the auxiliary row driving circuit are enabled when the character display mode is selected.

An organic electroluminescent display device in the fourteenth aspect of the present invention can be characterized in that, in the organic electroluminescent display device in the ninth or thirteenth aspect of the present invention, the number of grayscale levels is smaller when the character display mode is selected than when the full-dot display mode is selected.

An organic electroluminescent display device in the fifteenth aspect of the present invention can be characterized in that, in the organic electroluminescent display device in the ninth, thirteenth, or fourteenth aspect of the present invention, a frame frequency is lower when the character display mode is selected than when the full-dot display mode is selected.

An organic electroluminescent display device in the sixteenth aspect of the present invention can be characterized in that, in the organic electroluminescent display device in the ninth, thirteenth, fourteenth, or fifteenth aspect of the present invention, all pixels can be reset altogether when the full-dot display mode changes to the character display mode.

In order to further achieve the foregoing object, the electronic apparatus according to the present invention is an electronic apparatus having a display device that displays data, characterized in that the display device uses an electro-optical display device using the electro-optical device in the first to nineteenth aspects of the present invention, or the organic electroluminescent display device in the first to sixteenth aspects of the present invention.

Herein, according to the electro-optical device and the method of driving an electro-optical device in the first aspect of the present invention, since a auxiliary data line driving circuit can be provided separately from a primary data line driving circuit, a working mode is possible in which the data line driving circuit and the auxiliary data line driving circuit are selectively used according to the display form of the data lines. That is, separately from the data line driving circuit driven for the original purpose, the auxiliary data line driving circuit which can also be used for other applications, such as circuits, including a tester circuit and a precharge circuit is provided, and this auxiliary data line driving circuit can be selectively utilized.

According to the electro-optical device and the method of driving an electro-optical device in the second aspect of the present invention, since only a portion of the data lines is selectively connected to the auxiliary data line driving circuit, a working mode is possible in which the data line driving circuit is used when all of the data lines are used for display and the auxiliary data line driving circuit is used when a portion of the data lines is used for display.

According to the electro-optical device and the method of driving an electro-optical device in the third aspect of the present invention, since at least one of the data line driving circuit and the auxiliary data line driving circuit includes a decoder, arbitrary data lines of the data lines connected thereto can be selectively driven.

According to the electro-optical device and the method of driving an electro-optical device in the fourth aspect of the present invention, since at least one of the data line driving circuit and the auxiliary data line driving circuit includes a shift register, a large number of lines are not required to operate the data line driving circuit or the auxiliary data line driving circuit which includes the shift register.

According to the electro-optical device and the method of driving an electro-optical device in the fifth aspect of the present invention, since at least one of the data line driving circuit and the auxiliary data line driving circuit includes a latch circuit, a desired data line or scan line can be driven without providing, for example, address lines.

According to the electro-optical device and the method of driving an electro-optical device in the sixth aspect of the present invention, since at least one of the data line driving circuit and the auxiliary data line driving circuit includes a D/A converter circuit, for example, it is not required that the electro-optical device itself include a D/A converter circuit.

According to the electro-optical device and the method of driving an electro-optical device in the seventh aspect of the present invention, since the data lines connected to auxiliary data line driving circuit are data lines that are located in a specific region of a screen (for example, the left, center, or right region of the screen, provided that the data lines extend in the vertical direction of a screen), display only on the specific region of the screen can be performed in the state where the auxiliary data line driving circuit is used to drive the data lines.

According to the electro-optical device and the method of driving an electro-optical device in the eighth aspect of the present invention, only a particular color can be used for display in the state where the auxiliary data line driving circuit is used to drive the data lines.

According to the electro-optical device and the method of driving an electro-optical device in the ninth aspect of the present invention, a particular color can only be used for display in a specific region of the screen in the state where the auxiliary data line driving circuit is used to drive the data lines.

According to the electro-optical device and the method of driving an electro-optical device in the tenth aspect of the present invention, two display modes are selectable, i.e., a full-dot display mode in which an image is output using all dots constituting a screen, and a character display mode in which a character representative of a relative simple figure such as a letter or a symbol is displayed. With the inventive structure according to the electro-optical device and the method of driving an electro-optical device in the eighth aspect of the present invention, the former can also be expressed as a color display mode, and the latter as a particular color (monochrome) display mode.

Furthermore, according to the electro-optical device and the method of driving an electro-optical device in the tenth aspect of the present invention, the full-dot display mode can be supported by the primary data line driving circuit, and the character display mode can be supported by the auxiliary data line driving circuit. Therefore, all of the data lines are used for display when the full-dot display mode is selected, and a portion of the data lines can be used for display when the character display mode is selected, so that the display level of these display modes can be balanced with the number of data lines used.

According to the electro-optical device and the method of driving an electro-optical device in the eleventh aspect of the present invention, since an auxiliary row driving circuit is provided separately from a primary row driving circuit, wherein only a portion of the row lines is selectively connected to the auxiliary row driving circuit, a working mode is possible in which the row driving circuit is used if all of the row lines are used for display and the auxiliary row driving circuit is used if a portion of the row lines is used for display.

According to the electro-optical device and the method of driving an electro-optical device in the twelfth aspect of the present invention, since at least one of the scan line driving circuit and the auxiliary scan line driving circuit includes a decoder, arbitrary scan lines of the scan lines connected thereto can be selectively driven.

According to the electro-optical device and the method of driving an electro-optical device in the thirteenth aspect of the present invention, since at least one of the scan line driving circuit and the auxiliary scan line driving circuit includes a shift register, a large number of lines are not required to operate the scan line driving circuit and the auxiliary scan line driving circuit which include the shift register.

According to the electro-optical device and the method of driving an electro-optical device in the fourteenth aspect of the present invention, since the scan lines connected to auxiliary scan line driving circuit are scan lines that are located in a specific region of a screen (for example, the upper, middle, or lower region of the screen, provided that the scan lines extend in the horizontal direction of a screen), display only on the specific region of the screen can be performed in the state where the auxiliary scan line driving circuit is used to drive the scan lines. Therefore, if the electro-optical device and the method of driving an electro-optical device in the fourteenth aspect of the present inanition has the structure of the electro-optical device and the method of driving an electro-optical device in the seventh aspect of the present invention, a more detailed region such as the upper left, upper center, or lower right region of the screen can be designated as the specific region.

Furthermore, according to the electro-optical device and the method of driving an electro-optical device in the fifteenth aspect of the present invention, since the full-dot display mode is supported by the primary scan line driving circuit, and the character display mode is supported the auxiliary scan line driving circuit, all of the scan lines are used for display when the full-dot display mode can be selected, and a portion of the scan lines can be used for display when the character display mode is selected, so that the display level of these display modes can be balanced with the number of scan lines used.

According to the electro-optical device and the method of driving an electro-optical device in the sixteenth aspect of the present invention, for example, a working mode can also be used in which the number of grayscale levels is set the minimum 2 (that is, there are only two states where the electro-optical elements emit light and do not emit light) if the character display mode is selected and the number of grayscale levels is set 3 or more if the full-dot display mode is selected.

According to the electro-optical device and the method of driving an electro-optical device in the seventeenth aspect of the present invention, a frame frequency is reduced when the character display mode is selected, thereby providing a longer selection period of the scan lines or the data lines correspondingly.

According to the electro-optical device and the method of driving an electro-optical device in the eighteenth aspect of the present invention, since resetting altogether is possible, there is no need of an operation for scanning the entire screen in order to erase an image, thereby reducing excessive power consumption required when such an operation of scanning the entire screen is performed. Furthermore, when it changes to the character display mode where a letter, a symbol or the like is displayed, noise that makes it difficult to discriminate the letter or symbol can be prevented from remaining on the screen.

According to the electro-optical device and the method of driving an electro-optical device in the nineteenth aspect of the present invention, the data line driving circuit and the auxiliary data line driving circuit are switched to drive the data lines in a period during which scan lines of one screen are being driven, so that an image by the data line driving circuit and an image by the auxiliary data line driving circuit can be displayed in a period during which one screen is being displayed. Herein, a period during which the data line driving circuit and the auxiliary data line driving circuit are being driven is such that the data lines are driven by the data line driving circuit in a first half of the scan line driving period and the data lines are driven by the auxiliary data line driving circuit in a second half thereof, or, reversely, the data lines are driven by the auxiliary data line driving circuit in a first half of the scan line driving period and the data lines are driven by the data line driving circuit in a second half thereof.

According to the organic electroluminescent display device in the first aspect of the present invention, since an auxiliary data line driving circuit is provided separately from a primary data line driving circuit, wherein only a portion of the data lines is selectively connected to the auxiliary data line driving circuit, a working mode is possible in which the data line driving circuit is used if all of the data lines are used for display and the auxiliary data line driving circuit are used if a portion of the data lines is used for display. Furthermore, since the auxiliary data line driving circuit includes a decoder, arbitrary data lines of the data lines connected thereto can be selectively driven.

According to the organic electroluminescent display device in the second aspect of the present invention, since an auxiliary data line driving circuit is provided, wherein only a portion of the data lines is selectively connected to the auxiliary data line driving circuit, a working mode is possible in which the data line driving circuit is used if all of the data lines are used for display and the auxiliary data line driving circuit is used if a portion of the data lines is used for display. Furthermore, according to the organic electroluminescent display device in the second aspect of the present invention, since the auxiliary data line driving circuit includes a decoder, a large number of lines are not required to operate the auxiliary data line driving circuit.

According to the organic electroluminescent display device in the third aspect of the present invention, since the data line driving circuit includes a shift register, even if a large number of data lines driven thereby are required, an excessively large number of lines are not required to operate the data line driving circuit.

According to the organic electroluminescent display device in the fourth aspect of the present invention, since the row driving circuit includes a decoder, a working mode is possible in which only a row line necessary to use the auxiliary data line driving circuit is driven.

In the organic electroluminescent display device in the fourth aspect of the present invention, it is necessary that the decoder also be used to sequentially select and drive the row lines when the primary data line driving circuit is used to output an image on the entire screen. However, a period during which the row lines are being driven is significantly longer than a period during which the data lines are being driven. Hence, even if a large number of address selection lines connected to the decoder is required, a period during which the address selection lines are charged and discharged is not extremely shortened, so that the power consumption is prevented from extremely increasing as the address selection lines are driven.

According to the organic electroluminescent display device in the fifth aspect of the present invention, if the data lines connected to the auxiliary data line driving circuit are located in a specific region of a screen (for example, the left, center, or right region of the screen, provided that the data lines extend in the vertical direction of a screen), display only on the specific region of the screen can be performed in the state where the auxiliary data line driving circuit is used to drive the data lines.

According to the organic electroluminescent display device in the sixth aspect of the present invention, only a particular color can be used for display in the state where the auxiliary data line driving circuit is used to drive the data lines. In particular, according to the organic electroluminescent display device in the seven th aspect of the present invention, display with green (G) having the highest emission intensity and emission efficiency of all of the state-of-the-art organic EL materials is performed in the state where the auxiliary data line driving circuit is used to drive the data lines.

According to the organic electroluminescent display device in the eighth aspect of the present invention, only a particular color can be used for display in a specific region of a screen in the state where the auxiliary data line driving circuit is used to drive the data lines.

According to the organic electroluminescent display device in the ninth aspect of the present invention, two display modes are selectable, i.e., a full-dot display mode in which an image is displayed using all dots constituting a screen, and a character display mode in which a character representative of a relative simple figure such as a letter or a symbol is displayed. With the structure of the organic electroluminescent display device in the sixth or seventh aspect of the present invention, the former can also be expressed as a color display mode, and the latter as a particular color (monochrome) display mode.

Furthermore, according to the organic electroluminescent display device in the ninth aspect of the present invention, the full-dot display mode is supported by the primary data line driving circuit, and the character display mode is supported by the auxiliary data line driving circuit. Therefore, all of the data lines are used for display when the full-dot display mode is selected, and a portion of the data lines is used for display when the character display mode is selected, so that the display level of these display modes can be balanced with the number of data lines used.

According to the organic electroluminescent display device in the tenth aspect of the present invention, since an auxiliary row driving circuit is provided separately from a primary row driving circuit, wherein only a portion of the row lines is selectively connected to the auxiliary row driving circuit, a working mode is possible in which the row driving circuit is used if all of the row lines are used for display and the auxiliary row driving circuit is used if a portion of the row lines is used for display. In addition, the auxiliary row driving circuit includes a decoder, and an arbitrary row line of the row lines connected thereto can be selectively driven.

According to the organic electroluminescent display device in the eleventh aspect of the present invention, since an auxiliary row driving circuit is provided, wherein only a portion of the row lines is selectively connected to the auxiliary row driving circuit, a working mode is possible in which the row driving circuit is used if all of the row lines are used for display and the auxiliary row driving circuit is used if a portion of the row lines is used for display. Furthermore, according to the organic electroluminescent display device in the first aspect of the present invention, since the auxiliary row driving circuit includes a shift register, a large number of lines are not required to operate the auxiliary row driving circuit.

According to the organic electroluminescent display device in the twelfth aspect of the present invention, since the row lines connected to the auxiliary row driving circuit are row lines that are located in a specific region of a screen (for example, the upper, middle, or lower region of the screen, provided that the scan lines extend in the horizontal direction of a screen), display only on the specific region of the screen can be performed in the state where the auxiliary row driving circuit is used to drive the row lines. Therefore, if the organic electroluminescent display device in the twelfth aspect of the present invention has the structure of the organic electroluminescent display device in the fifth aspect of the present invention, a more detailed region such as the upper left, upper center, or lower right region can be designated as the specific region.

According to the organic electroluminescent display device in the thirteenth aspect of the present invention, since the full-dot display mode is supported by the primary row driving circuit, and the character display mode is supported by the auxiliary row driving circuit, all of the row lines are used for display when the full-dot display mode is selected, and a portion of the row lines is used for display when the character display mode is selected, so that the display level of these display modes can be balanced with the number of row lines used.

According to the organic electroluminescent display device in the fourteenth aspect of the present invention, for example, a working mode can also be used in which the number of grayscale levels is set the minimum 2 (that is, there are only two states where the electro-optical elements emit light and do not emit light) if the character display mode is selected and the number of grayscale levels is set 3 or more if the full-dot display mode is selected.

According to the organic electroluminescent display device in the fifteenth aspect of the present invention, a frame frequency is reduced when the character display mode is selected, thereby providing a longer selection period (a period during which they are being driven) of the row lines or the data lines correspondingly.

According to the organic electroluminescent display device in the sixteenth aspect of the present invention, since resetting altogether is possible, there is no need of an operation for scanning the entire screen in order to erase an image, thereby reducing excessive power consumption required when such an operation of scanning the entire screen is performed. Furthermore, when it changes to the character display mode where a letter, a symbol or the like is displayed, noise that make is difficult to discriminate the letter or symbol can be prevented from remaining on the screen.

According to the method of driving an electro-optical device in the twentieth aspect of the present invention can be characterized in that, in the method of the driving electro-optical device in the first to eighteenth aspects of the present invention, the data lines are driven by switching between the data line driving circuit and the auxiliary data line driving circuit in one horizontal scan period. For example, a period for supplying image signals and a period for supplying character signals can be provided in one horizontal scan period. In this case, it is preferable that the period for supplying image signals is longer than the period for supplying character signals because image signals require more data compared to character signals.

The electronic apparatus according to the present invention is an electronic apparatus having a display device for displaying data, wherein the display device comprises an electro-optical display device using the electro-optical device in the first to nineteenth aspects of the present invention, or the organic electroluminescent display device in the first to sixteenth aspects of the present invention, thereby making it possible to take the above-described bed advantages associated with the electro-optical device or the organic electroluminescent display device incorporating the present invention.

BRIEF DESCRIPTION OF THE DRAWINGS

The invention will be described with reference to the accompanying drawings, in which like elements are referred to with like numbers, and in which:

FIG. 1 is an exemplary circuit diagram of a first embodiment of the present invention.

FIG. 2 is a waveform for illustrating the operation of the first embodiment.

FIG. 3 is a characteristic chart of emission intensity of an organic electroluminescent material.

FIG. 4 is a characteristic chart of emission efficiency of the organic electroluminescent material.

FIG. 5 is an exemplary circuit diagram of a second embodiment of the present invention.

FIG. 6 is an exemplary circuit diagram of a third embodiment of the present invention.

FIG. 7 is an exemplary circuit diagram of the structure of each dot in the third embodiment.

FIG. 8 is an exemplary circuit diagram of a modification of the third embodiment.

FIG. 9 is a chart showing a relationship between voltage and brightness with respect to an external power supply in the configuration shown in FIG. 8.

FIG. 10 is a perspective view of an outer appearance structure of an electronic book as an example of an electronic element according to an embodiment of the present invention.

FIG. 11 is a perspective view of an outer appearance structure of an computer as an example of the electronic apparatus.

FIG. 12 is a perspective view of an outer appearance structure of a cellular phone as an example of the electronic apparatus.

FIG. 13 is a perspective view of an outer appearance structure of a digital still camera as an example of the electronic apparatus.

FIG. 14 is a chart used for illustrating that outputs of a data line driving circuit and outputs of an auxiliary data line driving circuit overlap each other.

FIG. 15 is an exemplary circuit diagram of the structure in which the data line driving circuit according to the first embodiment includes latch circuits.

FIG. 16 is a circuit diagram of a conventional structure.

DETAILED DESCRIPTION OF PREFERRED EMBODIMENTS

FIG. 1 shows an exemplary circuit diagram of components in an organic electroluminescent display device 10, which is a view of the structure of a first embodiment of the present invention. The same reference numerals are assigned to the same components as in the conventional organic electroluminescent display device shown in FIG. 16, and the detailed description of the same components is thus omitted.

The organic electroluminescent display device 10 according to the present embodiment can also include a plurality of data lines X1, X2, . . . , and Xn, and a plurality of scan lines Y1, Y2, . . . , and Ym as row lines which are arranged in a matrix manner, organic electroluminescent elements corresponding to R, G, and B colors, holding capacitances, etc., as is similar to the case in FIG. 16, which are located at intersections of the data lines X1 to Xn and the scan lines Y1 to Ym, data line driving circuit 40 for the data lines X1 to Xn, and scan line driving circuit 30 as a row driving circuit for driving the scan lines Y1 to Ym.

In the present embodiment, however, the scan line driving circuit 30 can include a decoder 33 instead of a shift register. Therefore, operations of the decoder 33 are controlled as appropriate so that the scan lines Y1 to Ym can be in turn driven in the same manner as in the case where a shift register is used, or arbitrary scan lines Y1 to Ym can be driven at an arbitrary timing.

An enable signal EnblX is supplied to a shift register 41 in the data line driving circuit 40, and an enable signal EnblY is supplied to the decoder 33 in the scan line driving circuit 30. As used herein, the data line driving circuit 40 is integrally formed on the same substrate as a display screen 20 which functions as a pixel unit.

The enable signals EnblX and EnblY are low level (logical value "0") signals in a normal state, and the shift register 41 and the decoder 33 perform normal operations when the low level enable signals EnblX and EnblY are supplied. On the other hand, the shift register 41 to which a high level (logical value "1") enable signal EnblX is supplied turns on all of the switching elements 42 at the same time, and the decoder 33 to which a high level enable signal EnblY is supplied drives all of the scan lines Y1 to Ym simultaneously.

While the high level enable signal EnbY is being generated, all of the video signal voltages VIDR, VIDG, and VIDB on the video signal lines 17R to 17B remain at the high level (strictly, the maximum potential in the conceivable range since they are analog voltage signals).

This organic electroluminescent display device 10 employs a so-called analog gradation method in which the video signal voltages VIDR, VIDG, and VIDB on the video signal lines 17R to 17B are output to the data lines X1 to Xn as analog signals, and, in this case, includes a D/A converter circuit. The D/A converter circuit may be incorporated in the data line driving circuit 40, or alternatively, may be separate from the data line driving circuit 40 in which the shift register 41 and the switching elements 42 are integrally formed on the display screen 20 so as to be a portion of an external IC driver.

The organic electroluminescent display device 10 includes an auxiliary data line driving circuit 50 in addition to the data line driving circuit 40. For example, the auxiliary data line driving circuit 50 is integrally formed on the same substrate as the display screen 20.

The auxiliary data line driving circuit 50 includes a decoder 51, and a plurality of switching elements 52, in which outputs of the decoder 51 are fed to the switching elements 52. In response to the outputs of the decoder 33, therefore, appropriate switching elements 52 can be turned on and off at an arbitrary timing.

First ends of the switching elements 52 are connected to the data lines X2, X5, X8, . . . , and X(n−1), out of the data lines X1 to Xn, which correspond to the organic electroluminescent elements capable of emitting green (G). In other words, all of the data lines X1 to Xn are connected to the data line driving circuit 40, while only a portion of the data lines X1 to Xn, i.e., the data lines X2, X5, X8, and X(n−1) corresponding to the organic electroluminescent elements capable of emitting G, is selectively connected to the auxiliary data line driving circuit 50.

Second ends of the switching elements 52 are connected to a power supply line 53 on which a character display voltage VCHR which causes the organic electroluminescent elements to emit light is supplied. The present embodiment has a structure similar to the conventional one (see FIG. 16) in which the PMOS transistors 13 are provided between the organic electroluminescent elements 12 and the common feeder lines 11, and the character display voltage VCHR goes low (for example, ground voltage) when it causes the organic electroluminescent elements to emit light, and goes high when it causes the organic electroluminescent elements to be turned off.

The basic structure of the organic electroluminescent display device 10 in the present embodiment is as described above, in which one contemplated working aspect is to set and distinguishably use two modes, i.e., a mode in which all dots in the display screen 20 are used to display an image (a full-dot display mode or a color display mode) and a mode in which only green (G) of the display screen 20 is emitted to display a letter or a symbol (a character display mode or a monochrome display mode).

The former color display mode is such that the scan line driving circuit 30 and the data line driving circuit 40 are enabled for display control of the display screen 20, and the latter monochrome display mode is such that the scan line driving circuit 30 and the auxiliary data line driving circuit 50 are enabled for display control of the display screen 20.

In this case, in the color display mode, since the light emission is controlled using the video signal voltages VIDR, VIDG, and VIDB which are analog voltages, for example, eight grayscale levels can be given for each color. On the other hand, in the monochrome display mode, since the light emission is controlled using the character display voltage VCHR which changes between two stages, i.e., low and high levels, the organic electroluminescent elements have only two states where color is emitted and where color is not emitted, namely, two grayscale levels. Therefore, the number of grayscale levels is smaller when the monochrome display mode is selected than when the color display mode is selected.

FIG. 2 shows a waveform of the states of signals of the organic electroluminescent display device 10 in the present embodiment, showing that a color display mode selected period T1 changes to a monochrome display mode selected period T2.

During the color display mode selected period T1, the scan line driving circuit 30 and the data line driving circuit 40 are enabled, where the decoder 33 in the scan line driving circuit 30 in turn drives the scan lines Y1 to Ym and the shift register 41 in the data line driving circuit 40 performs an operation on all of the switching elements 42 to sequentially turn on the switching elements 42 one-by-one while one of the scan lines Y1 to Ym is being driven. The color display mode selected period T1 shown in FIG. 2 depicts the manner how the scan lines Y1 to Y6 are sequentially driven. In practice, all of the scan lines Y1 to Ym are driven in the same manner, and all of the data lines X1 to Xn are sequentially driven one-by-one at a high rate while one scan line Yi is being driven.

During the color display mode selected period T1, in synchronization with the driving timing of the scan lines Y1 to Ym and the data lines X1 to Xn, the video signal voltages VIDR, VIDG, and VIDB which represent desired image data using analog voltages for each pixel or each original color are switched over at a high rate. Thus, each time the data lines X1 to Xn are driven by the data line driving circuit 40 for one cycle, the image data corresponding to one scan line Yi is output on the display screen 20, and each time the scan lines Y1 to Ym are driven by the scan line driving circuit 30 for one cycle, the image data corresponding to the entire screen is output on the display screen 20.

When the color display mode selected period T1 changes to the monochrome display mode period T2, first, the enable signals EnblX and EnblY which have been low go high. Then, the decoder circuit 33 drives all of the scan lines Y1 to Ym simultaneously, and the shift register 41 turns on all of the switching elements 42. At this time, the video signal voltages VIDR, VIDG, and VIDB also remain at the high level. This allows high level voltages to be charged in all of the holding capacitances in the display screen 20 to produce an interruption between the organic electroluminescent elements and the common feeder lines, thereby making all of the organic electroluminescent elements disabled. That is, all pixels in the display screen 20 are reset altogether.

After time has elapsed during which such a reset operation is ensured, the high level enable signals EnblX and EnblY again go low, and remain at the low level after that. Once the enable signals EnblX and EnblY again go low, the decoder circuit 31 returns all of the scan lines Y1 to Ym to the low level simultaneously, and the shift register 41 again turns off all of the switching elements 42 simultaneously. At this time, the video signal voltages VIDR, VIDG, and VIDB are also returned to the low level, and remain at the low level after that.

Then, the auxiliary data line driving circuit 50 is enabled instead of the data line driving circuit 40, and display control in the monochrome display mode period T2 starts.

In the monochrome display mode period T2, arbitrary scan lines Y1 to Ym are driven by the decoder 33 at an arbitrary timing, and the decoder 51 allows arbitrary data lines X2, X5, X8, . . . , and X(n−1) corresponding to G to be connected to the power supply line 53 at an arbitrary timing, thereby making it possible to charge the associated holding capacitances at an arbitrary timing. Since low level character display voltage VCHR is supplied to the power supply line 53 at this time, low level voltages are held in the holding capacitances selected by the decoders 33 and 51, so that the organic electroluminescent element is electrically coupled to the common feeder line to make the organic electroluminescent element ready to emit light.

That is since only arbitrary dots (however, only G) can be turned on in the monochrome display mode period T2, arbitrary dots are turned on according to the shape of a desired character such as a letter or a symbol to output the character on the display screen 20.

In this way, once an arbitrary dot which has been turned off is selected by the decoders 33 and 51 capable of being randomly accessed while the low level character display voltage VCHR is being supplied to the power supply line 53, that dot changes from the off state to the on state. Once a particular dot which has been turned on is selected by the decoders 33 and 51 while the high-level character display voltage VCHR is being supplied to the power supply line 53, that dot changes from the on state to the off state. Therefore, character display can be achieved such that a portion where a character is additionally displayed or where a character is to be rewritten is sequentially selected.

With the structure of the present embodiment, therefore, it is only required to drive the scan lines Y1 to Ym and data lines X2, X5, . . . , and Xn necessary in order to display a character in the monochrome display mode period T2, and there is no need to wastefully drive the scan lines or data lines which are located in a region which does not pertain to the display, thereby reducing the power consumption.

As the number of scan lines and data lines that must be driven is smaller, a frame frequency can be reduced, and a selection period of the scan lines Y1 to Ym or the data lines X2, X5, . . . , and Xn can be longer correspondingly to the reduction in the frame frequency (FIG. 2 shows that a selection period of the scan lines is longer in the monochrome display mode period T2 than in the color display mode period T1). The time required for charging or discharging can be thus set longer, making it possible to reduce the power consumption compared with the case where they are driven at a high rate.

Furthermore, according to the present embodiment, in the monochrome display mode period T2, a character is displayed in monochrome (only G) and two grayscale levels are used without any intermediate grayscale levels, so that the power consumption can be greatly reduced compared with the conventional organic electroluminescent display device in which a character is displayed in full color.

The monochrome display mode uses green (G), and G luminescent material which is available for practical usage in the state of the art has a higher emission intensity, as shown in FIG. 3, and also has a higher emission efficiency, as shown in FIG. 4, than R luminescent material or B luminescent material. For this reason, in order to display a character at an equivalent intensity level or amount of emission, the power consumption can be lowest by using G luminescent material, as in the present embodiment, than by using any other material.

With the structure of the present embodiment, therefore, the power consumption can be reduced at a variety of points, and the whole power consumption can be reduced compared with the conventional organic electroluminescent display device. As a result, it is particularly suitable for a display device for use in electronic apparatuses, such as portable information terminals (cellular phones), which require lower power consumption.

FIG. 5 is an exemplary circuit diagram of components of an organic electroluminescent display device 10 according to a second embodiment of the present invention. The same reference numerals are assigned to the same components as in the first embodiment, and a redundant description thereof is thus omitted.

First, the basic structure of the organic electroluminescent display device 10 in the present embodiment is similar to that in the first embodiment, and what is different is the following three points: 1) the scan line driving circuit 30 includes a shift register 31; 2) only a portion of the data lines X2, X5, X8, . . . , and X(n−1) corresponding to the organic electroluminescent elements capable of emitting G is selectively connected to the auxiliary data line driving circuit 50; and 3) an auxiliary scan line driving circuit 60 as an auxiliary row driving circuit is provided in addition to the scan line driving circuit 30.

Specifically, the scan line driving circuit 30 can be formed of the shift register 31 and a buffer 32, as in the conventional organic electroluminescent display device 10 shown in FIG. 16. The enable signal EnblY similar to that in the first embodiment is input to the shift register 31, and an input of high level enable signal EnblY causes the shift register 31 to drive all of the scan lines Y1 to Ym simultaneously.

The decoder 51 in the auxiliary data line driving circuit 50 controls to turn on and off the switching elements 52, as in the first embodiment. However, not all of the data lines X2, X5, X8, . . . , and X(n−1) corresponding to the organic electroluminescent elements capable of emitting G but only data lines (the data lines X5 and X8 in FIG. 5) which are located in specific regions of the display screen 20 can be connected to the power supply line 53 via the switching elements 52.

The auxiliary scan line driving circuit 60 can be formed of a decoder 61 and a buffer 62, and, of the scan lines Y1 to Ym, only scan lines (the scan lines Y2, Y3, Y5, and Y6 in FIG. 5) that are located in specific regions of the display screen 20 are selectively connected to the output of the buffer 62. Therefore, where the auxiliary scan line driving circuit 60 os enabled, arbitrary scan lines of the particular scan lines Y2, Y3, Y5, Y6, . . . can be driven in response to the output of the decoder 61 at an arbitrary timing.

Also in the structure of the present embodiment, in the color display mode period T1, the scan line driving circuit 30 and the data line driving circuit 40 are enabled to perform display control similar to that in the conventional organic electroluminescent display device.

When it changes to the monochrome display mode period T2, as in the first embodiment, the enable signals EnblX and EnblY go high, and the shift register 31 allows all of the scan lines Y1 to Ym to be driven simultaneously, while the shift register 41 allows all of the switching elements 42 to be turned on. The video signal voltages VIDR, VIDG, and VIDB also remain at the high level, so that-all pixels in the display screen 20 are reset altogether.

Then, after the enable signals EnblX and EnblY again go low, the auxiliary scan line driving circuit 60 and the auxiliary data line driving circuit 50 are enabled.

Accordingly, the decoder 61 allows arbitrary scan lines of the particular scan lines Y2, Y3, Y5, Y6, . . . to be driven at an arbitrary timing, while the decoder 51 allows the arbitrary data lines X5, X8, . . . that correspond to G to be connected to the power supply line 53 at an arbitrary timing, thereby making possible to charge arbitrary holding capacitances corresponding to the dots positioned in specific regions of the display screen 20 at an arbitrary timing.

That is, since only particular dots (only G, however) positioned in specific regions of the display screen 20 can be turned on in the monochrome display mode period T2, dots appropriate for the shape of a desired character such as a letter or a symbol are turned on to output the character in the specific regions of the display screen 20. Therefore, the present embodiment takes the same advantages as those in the first embodiment, with a difference in view of the entire display screen 20 in the first embodiment and specific regions of the display screen 20 in the second embodiment.

According to the present embodiment, the scan line driving circuit 30 including the shift register 31 can be utilized in the color display mode period T1, and, the auxiliary scan line driving circuit 60 including the decoder 61 is utilized in the monochrome display mode period T2, and the auxiliary scan line driving circuit 60 can drive only a portion of the scan lines. Therefore, the number of lines can greatly decrease compared with the first embodiment in which the scan line driving circuit 30 includes a decoder. Since the power consumption required to drive the decoder 61 is lower than the power consumption required to drive the decoder 33, the power consumption can be further reduced in the organic electroluminescent display device 10.

Also with respect to the auxiliary data line driving circuit 50, the number of switching elements 52 which are controlled to be turned on and off by the decoder 51 is smaller than that in the first embodiment, thereby reducing the number of lines correspondingly, leading to a reduction in power consumption.

FIGS. 6 and 7 illustrate a third embodiment of the present invention. FIG. 6 shows an exemplary circuit diagram of components of an organic electroluminescent display device 10. The same reference numerals are assigned to the same components as in the first and second embodiments, and a redundant description thereof is thus omitted.

The organic electroluminescent display device 10 in the present embodiment includes data lines X1, X2, X3, . . . , and Xn having plural bits (in this example, 6 bits) of information per dot in order to control the light emission state for each pixel P using digital data. Furthermore, write control lines Wi and /Wi as row lines, power supply lines VDD and VSS for activating an inverter as described later, and a feeder line V0 electroluminescence for causing the organic electroluminescent elements to emit light are arranged in the row direction.

FIG. 7 shows an exemplary circuit diagram of a circuitry for causing the organic electroluminescent elements 12 to emit light, and, as shown in the same figure, a storage circuit 70 capable of storing 6 bits of digital information is positioned correspondingly to intersections of the data line Xi having a 6-bit lines d0 to d5 and the two write control lines Wi and /Wi that have a complementary relation to each other.

A storage unit per bit in the storage circuit 70 mainly includes a data retention unit 73 having two inverters 71 and 72 connected in parallel to each other, and data on any of the lines d0 to d5 constituting the data line Xi is fed to one node of the data retention unit 73 via another inverter 74. The other node of the data retention unit 73 is connected to the gate of any of PMOS transistors 75.

In the present embodiment, each of the organic electroluminescent elements 12 is formed of six regions having different areas with a ratio of:

$$S1:S2:S3:S4:S5:S6=1:2:4:8:16:32$$

where S1 to S6 denote areas of the six regions, respectively. A current can be fed from the feeder line V0 electroluminescence to each of these regions of the organic electroluminescent elements 12 via any of the PMOS transistors 75.

Signals on the write control lines Wi and $\overline{Wi}$, and the potentials of the power supply lines VDD and VSS are fed to the storage circuit 70, and each of the inverters 71, 72, and 73 operates the voltages of the power supply lines VDD and VSS at the high level and the low level. When the write control line Wi is high (therefore, the write control line $\overline{Wi}$ is low), the inverter 74 is active, and the inverter 72 is inactive. When the write control line Wi is low (therefore, the write control line $\overline{Wi}$ is high), the inverter 74 is inactive, and the inverter 72 is active.

Since the write control lines Wi and $\overline{Wi}$ are commonly fed to the bits of the storage circuit 70, eventually, when the write control line Wi is high, a connection is established between the data retention units 73 in the storage circuit 70 and the data lines d0 to d5, while disabling the inverters 72 to retain the data, thereby allowing the data to be written into the storage circuit 70. When the write control signal Wi is low, an interruption occurs between the data retention units 73 and the data lines d0 to d5, while enabling the inverters 72 to retain the data, thereby allowing the data of one bit to be saved in each of the data retention units 73.

Referring again to FIG. 6, the write control lines Wi and $\overline{Wi}$ are connected to a word line driving circuit 35 as a row driving circuit. The word line driving circuit 35 is formed of a decoder 36 and a buffer 37. With respect to a set of the write control lines Wi and $\overline{Wi}$ which has been selected by the decoder 36, the write control line Wi is high and the write control line $\overline{Wi}$ is low. With respect to other write control lines Wi and $\overline{Wi}$ which have not been selected by the decoder 36, the write control line Wi is low and the write control line $\overline{Wi}$ is high.

On the other hand, each of the data lines X1 to Xn is connected to a data line driving circuit 40. The data line driving circuit 40 is formed of a decoder 45, an input control circuit 46, and a column selection switch unit 47.

Each output of the decoder 45 is branched into the number of bits k (in this example, k=6)×3 (3 is a number corresponding to the three primary colors of R, G, and B constituting a pixel P) of digital data per dot, and the branched output lines intersect k×3 output lines of the input control circuit 46. Switching elements 47*a* in the column selection switch unit 47 are arranged so that the branched output lines of the decoder 45 correspond to the output lines of the input control circuit 46 one-to-one.

When an arbitrary output is selected by the decoder 45, the branched output lines of the selected output activates the associated switching elements 47*a* in the column selection switch 47, and the outputs of the input control circuit 46 are fed to the display screen 20 side according to the activated switching elements 47*a* in unit of a set of data lines (for example, X1, X2 and X3). The image data fed to the display screen 20 side are written into the single storage circuit 70 which is ready for writing by the write control lines Wi and $\overline{Wi}$ which are selected at that time.

k×3 bits of image signals are fed to the input control circuit 46 from a memory controller 80, and the memory controller 80 is controlled by a CPU (not shown). The decoders 36 and 45 are designed so that addresses respectively selected thereby are controlled by an address buffer 81, and the address buffer 81 is controlled by a timing controller 82.

An enable signal EnblX is fed to the decoder 45 in the data line driving circuit 40, and an enable signal EnblY is fed to the decoder 36 in the word line driving circuit 35. Once high level enable signals EnblX and EnblY are input, the decoders 45 and 36 select all of the data lines X1 to Xn, and select all of the write control lines W1 to Wm. At this time, all of the image signals are high.

Also in the present embodiment, an auxiliary data line driving circuit 50 is provided, and, of the data lines X1 to Xn, data lines X2, X5, X8, . . . , and X(n−1) corresponding to the organic electroluminescent elements capable of emitting green (G) are connected to the auxiliary data line driving circuit 50. It is noted that not all of the lines d0 to d5 contained in each of the data lines X2, X5, X8, . . . , and X(n−1) but, of the lines d0 to d5, only the line d5 corresponding to the maximum area S6 in the organic electroluminescent elements 12 can be connected to the character display voltage VCHR via the switching element 52. In other words, also in the present embodiment, all of the data lines X1 to Xn are connected to the data line driving circuit 40, while only a certain line d5 of the particular data lines X2, X5, X8, . . . , and X(n−1) of the data lines X1 to Xn which correspond to the organic electroluminescent elements capable of emitting G is selectively connected to the auxiliary data line driving circuit 50.

In the present embodiment, in the color display mode period T1, the word line driving circuit 35 and the data line driving circuit 40 are enabled, so that the decoder 36 allows arbitrary write control lines Wi and $\overline{\text{Wi}}$ to be selected and the decoder 41 allows an arbitrary data line Xi to be selected, the data line Xi on which k×3 bits of image signals are carried and are fed to the display screen 20 side. Then, the image signals carried on the data line Xi are written into the storage circuit 70 for each of R, G, and B contained in the pixel P which has been selected by the write control lines Wi and $\overline{\text{Wi}}$.

Herein, for example, where a high level signal is 1 and a low level signal is 0, and if signal of 0 is fed to the line d5 and signals of 1 are fed to the other lines d0 to d4, the output of the inverter 74 connected to the line d5 in the storage circuit 70 becomes 1, and the outputs of the inverters 74 connected to the other lines d0 to d4 become 0. Thus, data of 100000 are written into the nodes of the inverters 74 of the data retention units 73 in the storage circuit 70, from the top in FIG. 7, and the data are inverted by the inverters 71 and are then fed to the gates of the PMOS transistors 75. Therefore, only the PMOS transistor 75 corresponding to the area S6 of the organic electroluminescent element 12 is turned on, while the other PMOS transistors 75 are turned off. As a result, the organic electroluminescent elements 12 emit light only in the portion having the area S6. The mount of light relative to the sum of the areas (S1+S2+S3+S4+S5+S6) is 50% (=32/63). This light emitting state continues until the next timing at which another data is written into the storage circuit 70.

That is, since the ratio of the areas S1–S6 is set as described above, 64 grayscale levels per dot, namely, 262144 (=64×64×64) colors for each pixel P, can be output by appropriately setting the digital data to be written into each of the storage circuits 70 from the data line Xi.

When it changes to the monochrome display mode period T2, as in the first embodiment, the enable signals EnblX and EnblY go high, and all of the image signals go high, so that all pixels in the display screen 20 are reset altogether.

Then, after the enable signals EnblX and EnblY again go low, the auxiliary data line driving circuit 50 is enabled instead of the data line driving circuit 40.

Therefore, since the decoder 36 allows arbitrary write control lines Wi and /Wi to be selected while the decoder 51 allows the line d5 of the particular data lines X2, X5, X8, . . . corresponding to G to be connected to the power supply line 53 at an arbitrary timing, arbitrary pixels P can be emitted with G having an amount of emission of 50% (=32/63), which can be used to display a desired character.

Accordingly, the present embodiment takes the same advantages as those in the first embodiment, with a difference in view of analog data in the first embodiment and digital data in the third embodiment.

In the third embodiment, although a so-called area gradation method is used to allocate gradations to the amount of emission of each dot, a plurality of kinds of methods of allocating gradations to each dot using an external analog voltage may also be used.

FIG. 8 is a view showing an exemplary gradation method using an external analog voltage, showing one dot. Each dot has a plurality (in this example, four) of organic electroluminescent elements 12, and a PMOS transistor 13, an NMOS transistor 14, and a holding capacitance 15 are provided for each of the organic electroluminescent elements 12. The gates of the NMOS transistors are connected to a common word line W as a row line, and the sources of the NMOS transistors are connected to different lines d0 to d3.

The sides of the PMOS transistors 13 which are opposite to the organic electroluminescent elements 12, and the sides of the NMOS transistors 14 which are opposite to the holding capacitances 15 are connected to different common feeder lines V0 electroluminescence 1 to V0 electroluminescence 4, and the voltages of these common feeder lines V0 electroluminescence 1 to V0 electroluminescence 4 are set, as shown in FIG. 9, so that the brightness values B1 to B4 of the organic electroluminescent elements 12 which are produced by these voltages are: B1:B2:B3:B4=1:2:4:8.

With such a structure, where the brightness value is 15 when all of the organic electroluminescent elements 12 emit light for each dot, for example, a brightness value is 1/15 if only the organic electroluminescent element 12 associated with the line d0 emits light, a brightness value is 8/15 if only the organic electroluminescent element 12 associated with the line d4 emits light, or a brightness value is 3/15 if the organic electroluminescent element 12 associated with the line d0 and the organic electroluminescent element 12 associated with the line d1 emit light. Therefore, 16 gradations can be obtained for each dot.

Accordingly, even if such a gradation method is used in the third embodiment instead of the structure shown in FIG. 7, the same advantages as those in the third embodiment can be taken.

In the aforementioned embodiments, each of the data line driving circuit, the auxiliary data line driving circuit, the scan line driving circuit, the auxiliary scan line driving circuit can be disposed on a member including the data lines and the scan data lines or disposed separately from the member, correspondingly to a way. A silicon-base transistor as well as a thin-film transistor can be used as a transistor included in each of the aforementioned circuits. When at least one of the aforementioned circuits is disposed on the member, there is a case that it is preferable that transistors included in the at least one of the aforementioned circuits are thin-film transistors. When at least one of the aforementioned circuits is disposed separately from the member, there is a case that it is preferable that transistors included in the at least one of the aforementioned circuits are silicon-base transistors.

Several circuits of the aforementioned circuits can be combined and disposed together as one semiconductor device for controlling the data lines or the scan lines.

Next, the structure of an electronic apparatus according to embodiments of the present invention is described.

First, an example in which the present invention is applied to an electronic book which is an electronic apparatus is described. As shown in FIG. 10, an electronic book 91 allows data of an electronically published book which is stored in a storage medium such as a CD-ROM to be viewed on a display screen of a display device and to be read.

The electronic book 91 can include a book like frame 92, and a cover 93 capable of opening and closing with respect to the frame 92. The frame 92 includes a display device 94 having a display surface exposed thereon, and an operation unit 95.

The electronic book 91 is designed so that the display device 94 is constructed according to the above-described organic electroluminescent display device 10, and the display device 94 is driven by a driver (not shown).

Next, an exemplary application to a mobile personal computer which an electronic apparatus is described. FIG. 11 shows a perspective view of the structure of the personal computer. As shown in FIG. 11, the personal computer 100 includes a body 104 having a keyboard 102, and a display device 106 which can be constructed according to the above-described organic electroluminescent display device 10.

Next, an exemplary application to a display unit of a cellular phone which is an electronic apparatus is described. FIG. 12 shows a perspective view of the structure of the cellular phone 200. As shown in FIG. 12, the cellular phone 200 can include a plurality of operation buttons 202, an earpiece 206, a mouthpiece 204, and a display device 64 which can be constructed according to the above-described organic electroluminescent display device 10.

Furthermore, an exemplary application to a digital still-camera having it used for a finder is described. FIG. 13 shows a perspective view of the structure of the digital still camera 300, briefly showing also a connection to external apparatuses. A typical camera uses an optical image of an object to expose a film to light, while the digital still camera 300 uses imaging elements such as CCDs (Charge Coupled Devices) to photoelectrically convert an optical image of an object to generate an imaging signal.

A display device 304 which is constructed according to the above-described organic electroluminescent display device 10 can be disposed on a rear surface of a case 302 in the digital still camera 300 for making display based on the imaging signal by the CCD. The display device 304 thus functions as a finder to view an object. A light receiving unit 306 including an optical lens and the CCD is disposed on an observing side (a rear side in the figure) of the case 302.

When a photographer reviews an object image displayed on the display device 304 to press a shutter button 308, an imaging signal of the CCD at this time is transferred to and stored in a memory on a circuit board 310.

The digital still camera 300 can further include a video signal output terminal 312, and a digital communication input/output terminal 314 which are provided on a side surface of the case 302. As shown in FIG. 13, the former video signal output terminal 312 and the latter data communication input/output terminal 314 are connected to a television monitor 430 and a personal computer 440, respectively, if necessary. A predetermined operation allows the imaging signal stored in the memory on the circuit board 310 to be output to the television monitor 430 or the personal computer 440.

The electronic apparatuses include a liquid crystal television, a viewfinder type or monitor direct-viewing type video tape recorder, a car navigation device, a pager, an electronic organizer, a calculator, a word processor, a work station, a television telephone, a POS terminal, and an apparatus having a touch-sensitive panel, in addition to the electronic book 91 shown in FIG. 10, the personal computer 100 shown in FIG. 11, the cellular phone 200 shown in FIG. 12, and the digital still camera 300 shown in FIG. 13. Of course, the above-described display device can be implemented as display units in the various kinds of electronic apparatuses.

As described above, the present invention has been described with respect to a plurality of embodiments. However, it is to be understood that the present invention is not limited to implementation in the illustrated embodiments, and that various implementations may be utilized without departing from the spirit and scope of the present invention.

For example, although a portion of the data lines is selectively connected to the auxiliary data line driving circuit 50 in the illustrated embodiments, all of the data lines may be connected to the auxiliary data line driving circuit 50.

For example, although the data line driving circuit 40 and the auxiliary data line driving circuit 50 output voltage (values) corresponding to the data lines respectively connected thereto in the illustrated embodiments, they can also output current (values).

In the illustrated embodiments, the auxiliary data line driving circuit 50 has been described with respect to character display, and, specifically, can be used as a driving circuit of data lines to perform still image or straightforward display such as display of letters, indication of the radio field intensity in cellular phones, and display of dates, calendars, and desktop patterns, or tester circuit of disconnection etc, a precharger circuit, or the like.

The auxiliary data line driving circuit 50 may be operated in combination with the data line driving circuit 40, and overlapping the outputs of the auxiliary data line driving circuit 50 and the outputs of the data line driving circuit 40 can take advantage of, for example, image processing such as so-called superimposing. In this case, for example, if a horizontal scan signal for driving scan lines of one screen is output as shown in FIG. 14(A), the outputs from the data line driving circuit 40 and the outputs from the auxiliary data line driving circuit 50 are separated during that period; specifically, as shown in FIG. 14(B), a data signal (1) from the data line driving circuit 40 is output during a first half of the horizontal scanning period (horizontal scan line driving period), while, as shown in FIG. 14(C), it is switched to the auxiliary data line driving circuit 50 so that a data signal (2) from the auxiliary data line driving circuit 50 is output during a second half thereof. In this case, the periods (drive timings of the data lines) during which the data signal (1) and the data signal (2) are fed can be set as appropriate, and, as shown in the figure, the period during which the data signal (1) is fed is set longer than the period during which the data signal (2) is fed, by way of example. For example, if the data signal (1) is an image signal or a motion picture signal and the data signal (2) includes straightforward information, the period during which the data signal (1) is fed is set longer than the period during which the data signal (2) is fed.

With such a structure, when the auxiliary data line driving circuit 50 is used to display a character letter, the character letter may be viewed so as to overlap the underlying picture. For example, conventionally, the original image data (data residing on a memory) is directly and electrically processed. However, a display as described above can take equivalent image processing advantages with an extremely straightforward structure compared with such a processing.

With the driving timing of the data lines X1 to Xn using the data line driving circuit 40 and the auxiliary data line driving circuit 50, the auxiliary data line driving circuit 50 may precede in the horizontal scanning period, or, otherwise, the data line driving circuit 40 and the auxiliary data line driving circuit 50 may be alternately operated to drive the data lines X1 to Xn in the horizontal scanning period.

In the illustrated embodiments, the data line driving circuit 40 or the auxiliary data line driving circuit 50 may include a latch circuit. FIG. 15 shows a case where the organic electroluminescent display device 10 in the first embodiment includes two-stage, or first and second, latch circuits 81 and 82.

In the organic electroluminescent display device having such a structure, digital data are fed in parallel from data feeder lines D1 to Dm by sequentially selecting a plurality of switching elements 84 corresponding to the data lines X1 to Xn in synchronization with the shift operations of the shift register 41. Then, the data are sampled by the first latch circuit 81, and are then transferred to the second latch circuit 82, stored therein, and are output to the corresponding data lines X1 to Xn via a D/A converter circuit 83.

This organic electroluminescent display device 10 includes latch circuits which are arranged at output stages to the data lines X1 to Xn, allowing desired data lines to be driven without, for example, address lines.

Although the auxiliary data line driving circuit 50 is provided with the decoder 51 in the first embodiment, a shift register instead of the decoder 51 may be used. In the case where a shift register is used, the data lines X2, X5, X8, . . . , and X(n−1) must be sequentially driven even in the monochrome display mode period T2; however, it requires simpler wiring than the decoder 51, so that it is useful to employ it if not so large power consumption is required when the data lines are sequentially driven by the auxiliary data line driving circuit 50, for example, if there are not so many pixels.

Also in the second embodiment, one or both of the decoders 51 and 61 may be replaced with a shift register(s), and such a structure that uses a shift register(s) may also be useful if not so large power consumption is required when the data lines or the scan lines are sequentially driven by the auxiliary data line driving circuit 50 or the auxiliary scan line driving circuit 50, for example, if there are not so many pixels.

In the illustrated embodiments, a case where the electro-optical device is an organic electroluminescent display device has been described. However, it is to be understood that it is not limited, but that an electro-optical device may also be implemented as a liquid crystal device or an electrophoresis device accommodating an electrophoresis dispersion medium containing a liquid crystal dispersion and an electrophoresis particle. In summary, an electro-optical device according to the present invention can be characterized by including a plurality of data lines and scan lines which are arranged in a matrix manner, an electro-optical elements which are disposed correspondingly to intersections of the data lines and the scan lines, a data line driving circuit capable of driving the data lines, and an line driving circuit.

As described above, according to the present invention, provision of an auxiliary data line driving circuit, or both the auxiliary data line driving circuit and an auxiliary row driving circuit, takes advantage of reduced power consumption compared with the case where a data line driving circuit or a scan line driving circuit, or only a row driving circuit is used to perform display control, testing of disconnection etc., or precharging.

What is claimed is:

1. An electro-optical device, comprising:

a plurality of data lines and scan lines that are arranged in a matrix manner;

a plurality of electro-optical elements that are disposed correspondingly to intersections of the data lines and the scan lines;

a data line driving circuit connected to the data lines and capable of driving all of the data lines; and an auxiliary data line driving circuit selectively connected to a portion of all of the data lines capable of driving the portion of all of the data lines independently from the data line driving circuit, the portion of the data lines being connected to both the data line driving circuit and the auxiliary data line driving circuit.

2. The electro-optical device according to claim 1, at least one of the data line driving circuit and the auxiliary data line driving circuit including a decoder.

3. The electro-optical device according to claim 1, at least one of the data line driving circuit and the auxiliary data line driving circuit including a shift register.

4. The electro-optical device according to claim 1, at least one of the data line driving circuit and the auxiliary data line driving circuit including a latch circuit.

5. The electro-optical device according to claim 1, at least one of the data line driving circuit and the auxiliary data line driving circuit including a D/A converter circuit.

6. The electro-optical device according to claim 1, wherein, of the data lines, only a data line that is located in a specific region of a screen is selectively connected to the auxiliary data line driving circuit.

7. The electro-optical device according to claim 1, three dots including an electro-optical element capable of emitting red, an electro-optical element capable of emitting green, and an electro-optical element capable of emitting blue comprise one pixel to enable a color display, and only a data line corresponding to a particular color of the three colors is selectively connected to the auxiliary data line driving circuit.

8. The electro-optical device according to claim 7, only a data line which corresponds to the particular color and which is located in a specific region of a screen being selectively connected to the auxiliary data line driving circuit.

9. The electro-optical device according to claim 1, a full-dot display mode and a character display mode being switched so that the data line driving circuit is enabled when the full-dot display mode is selected and the auxiliary data line driving circuit is enabled when the character display mode is selected.

10. The electro-optical device according to claim 1, further comprising a scan line driving circuit capable of driving the scan lines, and an auxiliary scan line driving circuit capable of driving the scan lines independently from the scan line driving circuit, all of the scan lines being connected to the scan line driving circuit, and only a portion of the scan lines being selectively connected to the auxiliary scan line driving circuit.

11. The electro-optical device according to claim 10, at least one of the scan line driving circuit and the auxiliary scan line driving circuit including a decoder.

12. The electro-optical device according to claim 10, at least one of the scan line driving circuit and the auxiliary scan line driving circuit including a shift register.

13. The electro-optical device according to claim 10, wherein, of the scan lines, only a scan line that is located in a specific region of a screen is selectively connected to the auxiliary scan line driving circuit.

14. The electro-optical device according to claim 10, wherein a full-dot display mode and a character display mode can be switched so that the data line driving circuit and the scan line driving circuit are enabled when the full-dot display mode is selected and the auxiliary data line driving circuit and the auxiliary scan line driving circuit are enabled when the character display mode is selected.

15. The electro-optical device according to claim 9, the number of grayscale levels being smaller when the character display mode is selected than when the full-dot display mode is selected.

16. The electro-optical device according to claim 9, a frame frequency being lower when the character display mode is selected than when the full-dot display mode is selected.

17. The electro-optical device according to claim 9, all pixels being reset altogether when the full-dot display mode changes to the character display mode.

18. The electro-optical device according to claim 1, the data lines being driven by switching between the data line driving circuit and the auxiliary data line driving circuit in a period during which scan lines of one screen are being driven.

19. A method of driving an electro-optical device comprising a plurality of data lines and scan lines that are arranged in a matrix manner, and a plurality of electro-optical elements that are disposed correspondingly to intersections of the data lines and the scan lines, the method comprising:

switching between a data line driving circuit and an auxiliary data line driving circuit to drive the data lines, the data line driving circuit being capable of driving all of the data lines, the auxiliary data line driving circuit being capable of driving a selective portion of the data lines independently from the data line driving circuit, the portion of the data lines being connected to both of the data line driving circuit and the auxiliary data line driving circuit.

20. The method according to claim 19, all of the data lines being connected to the data line driving circuit, and only a portion of the data lines being selectively connected to the auxiliary data line driving circuit.

21. The method according to claim 19, at least one of the data line driving circuit and the auxiliary data line driving circuit including a decoder.

22. The method according to claim 19, at least one of the data line driving circuit and the auxiliary data line driving circuit including a shift register.

23. The method according to claim 19, at least one of the data line driving circuit and the auxiliary data line driving circuit including a latch circuit.

24. The method according to claim 19, at least one of the data line driving circuit and the auxiliary data line driving circuit including a D/A converter circuit.

25. The method according to claim 19, wherein, of the data lines, only a data line that is located in a specific region of a screen is selectively connected to the auxiliary data line driving circuit.

26. The method according to claim 19, three dots including an electro-optical element capable of emitting red, an electro-optical element capable of emitting green, and an electro-optical element capable of emitting blue comprise one pixel to enable a color display, and only a data line corresponding to a particular color of the three colors is selectively connected to the auxiliary data line driving circuit.

27. The method according to claim 26, only a data line which corresponds to the particular color and which is located in a specific region of a screen being selectively connected to the auxiliary data line driving circuit.

28. The method according to claim 19, full-dot display mode and a character display mode being switched so that the data line driving circuit is enabled when the full-dot display mode is selected and the auxiliary data line driving circuit is enabled when the character display mode is selected.

29. The method according to claim 19, further comprising switching between a scan line driving circuit and an auxiliary scan line driving circuit to drive the scan lines, the scan line driving circuit to which all of the scan lines are connected being capable of driving the scan lines, the auxiliary scan line driving circuit to which only a portion of the scan lines is selectively connected being capable of driving the portion of the scan lines independently from the scan line driving circuit.

30. The method according to claim 29, wherein at least one of the scan line driving circuit and the auxiliary scan line driving circuit including a decoder.

31. The method according to claim 29, at least one of the scan line driving circuit and the auxiliary scan line driving circuit including a shift register.

32. The method according to claim 29, wherein, of the scan lines, only a scan line that is located in a specific region of a screen is selectively connected to the auxiliary scan line driving circuit.

33. The method according to claim 29, a full-dot display mode and a character display mode being switched so that the data line driving circuit and the scan line driving circuit are enabled when the full-dot display mode is selected and the auxiliary data line driving circuit and the auxiliary scan line driving circuit are enabled when the character display mode is selected.

34. The method according to claim 28, the number of grayscale levels being smaller when the character display mode is selected than when the filldot display mode is selected.

35. The method according to claim 28, a frame frequency being lower when the character display mode is selected than when the full-dot display mode is selected.

36. The method according to claim 28, all pixels being reset altogether when the full-dot display mode changes to the character display mode.

37. The method according to claim 19, the data lines being driven by switching between the data line driving circuit and the auxiliary data line driving circuit in a period during which scan lines of one screen are being driven.

38. An organic electroluminescent display, comprising:

a plurality of row lines and data lines that are arranged in a matrix manner;

a plurality of organic electroluminescent elements that are disposed correspondingly to intersections of the row lines and the data lines;

a data line driving circuit capable of driving the data lines;

a row driving circuit capable of driving the row lines; and an auxiliary data line driving circuit, independently from the data line driving circuit, that drives a selective portion of the data lines, the auxiliary data line driving circuit including a decoder, the data lines are connected to the data line driving circuit and only the selective portion of the data lines are connected to both the auxiliary data line driving circuit and the data line driving circuit.

39. An organic electroluminescent display, comprising:

a plurality of row lines and data lines that are arranged in a matrix manner;

a plurality of organic electroluminescent elements that are disposed correspondingly to intersections of the row lines and the data lines;

a data line driving circuit capable of driving the data lines;

a row driving circuit capable of driving the row lines; and an auxiliary data line driving circuit, independently from the data line driving circuit, that drives a selective portion of the data lines, the auxiliary data line driving circuit including a shift register, the data lines are connected to the data line driving circuit and only the selective portion of the data lines are connected to the auxiliary data line driving circuit and the data line driving circuit.

40. The organic electroluminescent display device according to claim 38, the data line driving circuit including a shift register.

41. The organic electroluminescent display device according to claim 38, the row driving circuit including a decoder.

42. The organic electroluminescent display device according to claim 38, wherein, of the data lines, only a data line that is located in a specific region of a screen is selectively connected to the auxiliary data line driving circuit.

43. The organic electroluminescent display device according to claim 38, three dots including an organic electroluminescent element capable of emitting red, an organic electroluminescent element capable of emitting green, and an organic electroluminescent element capable of emitting blue comprise one pixel to enable a color display, and only a data line corresponding to a particular color of the three colors is selectively connected to the auxiliary data line driving circuit.

44. The organic electroluminescent display device according to claim 43, the particular color being green.

45. The organic electroluminescent display device according to claim 43, only a data line which corresponds to the particular color and which is located in a specific region of a screen being selectively connected to the auxiliary data line driving circuit.

46. The organic electroluminescent display device according to claim 38, a full-dot display mode and a character display mode being switched so that the data line driving circuit is enabled when the full-dot display mode is selected and the auxiliary data line driving circuit is enabled when the character display mode is selected.

47. The organic electroluminescent display device according to claim 38, further comprising an auxiliary row line driving circuit, independent from the row driving circuit, that drives the row lines, the auxiliary row driving circuit including a decoder, wherein all of the row lines are connected to the row driving circuit and only a portion of the row lines is selectively connected to the auxiliary row driving circuit.

48. The organic electroluminescent display device according to claim 38, further comprising an auxiliary row driving circuit, independent from the row driving circuit, that drives the row lines, the auxiliary row driving circuit including a shift register, wherein all of the row lines are connected to the row driving circuit and only a portion of the row lines is selectively connected to the auxiliary row driving circuit.

49. The organic electroluminescent display device according to claim 47, wherein, of the row lines, only a row line that is located in a specific region of a screen is selectively connected to the auxiliary row driving circuit.

50. The organic electroluminescent display device according to claim 48, a full-dot display mode and a character display mode being switched so that the data line driving circuit and the row driving circuit are enabled when the full-dot display mode is selected and the auxiliary data line driving circuit and the auxiliary row driving circuit are, enabled when the character display mode is selected.

51. The organic electroluminescent display device according to claim 46, the number of grayscale levels being smaller when the character display mode is selected than when the full-dot display mode is selected.

52. The organic electroluminescent display device according to claim 46, a frame frequency being lower when the character display mode is selected than when the full-dot display mode is selected.

53. The organic electroluminescent display device according to claim 46, all pixels being reset altogether when the full-dot display mode changes to the character display mode.

54. The method according to claim 19, the data lines being driven by switching between the data line driving circuit and the auxiliary data line driving circuit in one horizontal scan period.

55. An electronic apparatus comprising a display device for displaying data, said display device comprising an electro-optical display device using the electro-optical device according to claim 1.

56. The electro-optical device according to claim 14, the number of grayscale levels being smaller when the character display mode is selected than when the full-dot display mode is selected.

57. The electro-optical device according to claim 14, a frame frequency being lower when the character display mode is selected than when the full-dot display mode is selected.

58. The electro-optical device according to claim 14, all pixels being reset altogether when the full-dot display mode changes to the character display mode.

59. The method according to claim 33, the number of grayscale levels being smaller when the character display mode is selected than when the full-dot display mode is selected.

60. The method according to claim 33, a frame frequency being lower when the character display mode is selected than when the full-dot display mode is selected.

61. The method according to claim 33, all pixels being reset altogether when the full-dot display mode changes to the character display mode.

62. The organic electroluminescent display device according to claim 39, the data line driving circuit including a shift register.

63. The organic electroluminescent display device according to claim 39, the row driving circuit including a decoder.

64. The organic electroluminescent display device according to claim 39, wherein, of the data lines, only a data line that is located in a specific region of a screen is selectively connected to the auxiliary data line driving circuit.

65. The organic electroluminescent display device according to claim 37, three dots including an organic electroluminescent element capable of emitting red, an organic electroluminescent element capable of emitting green, and an organic electroluminescent element capable of emitting blue comprise one pixel to enable a color display, and only a data line corresponding to a particular color of the three colors is selectively connected to the auxiliary data line driving circuit.

66. The organic electroluminescent display device according to claim 65, the particular color being green.

67. An electro-optical device, comprising:

a plurality of data lines and scan lines that are arranged in a matrix manner;

a plurality of electro-optical elements that are disposed correspondingly to intersections of the data lines and the scan lines;

a data line driving circuit capable of driving the data lines;

an auxiliary data line driving circuit capable of driving the data lines independently from the data line driving circuit, a number of grayscale levels displayed by using the auxiliary data line driving circuit being smaller than those of the data line driving circuit.

68. The electro-optical device according to claim 67, the auxiliary data line driving circuit controlling two grayscale.

69. The electro-optical device according to claim 67, the auxiliary data line driving circuit including a decoder.

70. The electro-optical device according to claim 1, the plurality of electro-optical elements being between the data line driving circuit and the auxiliary data line driving circuit.

71. The organic electroluminescent display according to claim 38, the plurality of organic electroluminescent elements being between the data line driving circuit and the auxiliary data line driving circuit.

72. The organic electroluminescent display according to claim 39, the plurality of organic electroluminescent elements being between the data line driving circuit and the auxiliary data line driving circuit.

73. An electronic apparatus comprising a display device for displaying data, said display device comprising the organic electroluminescent display according to claim 38.

* * * * *